US009419356B2

(12) United States Patent
Copper et al.

(10) Patent No.: US 9,419,356 B2
(45) Date of Patent: Aug. 16, 2016

(54) ELECTRICAL POWER CONTACT WITH TWO ADJACENT CONTACT BLADES ABUTTING EACH OTHER

(71) Applicant: FCI Americas Technology LLC, Carson City, NV (US)

(72) Inventors: Charles Copper, Etters, PA (US); Christopher S. Gieski, Etters, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/761,486

(22) PCT Filed: Mar. 13, 2014

(86) PCT No.: PCT/US2014/025437

§ 371 (c)(1),
(2) Date: Jul. 16, 2015

(87) PCT Pub. No.: WO2014/159908

PCT Pub. Date: Oct. 2, 2014

(65) Prior Publication Data

US 2015/0357734 A1 Dec. 10, 2015

Related U.S. Application Data

(60) Provisional application No. 61/784,506, filed on Mar. 14, 2013.

(51) Int. Cl.

| | |
|---|---|
| ***H01R 41/00*** | (2006.01) |
| ***H01R 12/70*** | (2011.01) |
| ***H01R 13/14*** | (2006.01) |
| ***H01R 13/08*** | (2006.01) |

(52) U.S. Cl.
CPC ..... *H01R 12/7076* (2013.01); *H01R 12/7088* (2013.01); *H01R 13/08* (2013.01); *H01R 13/14* (2013.01); *H01R 41/00* (2013.01)

(58) Field of Classification Search
CPC ..... H01R 35/00; H01R 35/04; H01R 39/00; H01R 39/24; H01R 39/26; H01R 41/00
USPC ..... 439/660, 10
See application file for complete search history.

(56) References Cited

U.S. PATENT DOCUMENTS

| | | | |
|---|---|---|---|
| 4,845,589 | A | 7/1989 | Weidler et al. |
| 5,342,226 | A | 8/1994 | Hayes et al. |
| 5,431,576 | A | 7/1995 | Matthews |

(Continued)

FOREIGN PATENT DOCUMENTS

KR 10-2012-0129231 11/2012

*Primary Examiner* — Chandrika Prasad
(74) *Attorney, Agent, or Firm* — Wolf, Greenfield & Sacks, P.C.

(57) ABSTRACT

A power connector can include a dielectric connector housing and electrical contacts that are supported by the housing. The electrical contacts can each include first and second contact bodies. The first contact body can include a first contact blade and the second contact body can include a second contact blade that can define a mating portion of the electrical contact. The mating portion can be configured to mate with a complementary power connector along a mating direction so as to establish an electrical connection between the power connector and the complementary power connector. The contact blades can be configured slide with respect to each other along the mating direction.

24 Claims, 13 Drawing Sheets

(56) References Cited

U.S. PATENT DOCUMENTS 5,741,148 A 4/1998 Biernath
5,927,996 A * 7/1999 Savage ..... H01R 35/02 439/1
6,171,155 B1 1/2001 Miwa et al.
6,254,440 B1 7/2001 Ko et al.
6,402,566 B1 * 6/2002 Middlehurst ..... H01R 13/113 439/680
6,629,492 B1 * 10/2003 Li ..... A47J 43/046 241/37.5
6,663,426 B2 12/2003 Hasircoglu et al.
7,056,136 B2 6/2006 Iwasaki
7,059,907 B2 6/2006 Winings et al.
7,241,167 B2 * 7/2007 Yamada ..... H01R 12/7064 439/260
7,581,972 B2 9/2009 Daamen
7,837,497 B1 * 11/2010 Matsuo ..... H01R 12/62 439/629
7,976,317 B2 * 7/2011 Patel ..... H01R 12/7088 439/699.1
8,062,046 B2 11/2011 Daily et al.
8,079,861 B2 * 12/2011 Suzuki ..... H01R 12/61 439/260
8,096,814 B2 1/2012 Schell et al.
8,317,553 B2 * 11/2012 Nishide ..... H01R 13/05 439/884
8,449,329 B1 * 5/2013 Schroll ..... H01R 13/6586 439/607.05
8,591,250 B2 * 11/2013 Chin ..... H01R 12/724 439/485
2004/0127092 A1 * 7/2004 Yamada ..... H01R 12/7064 439/498
2010/0068938 A1 * 3/2010 Suzuki ..... H01R 12/61 439/638
2010/0304614 A1 * 12/2010 Matsuo ..... H01R 12/62 439/629

* cited by examiner

ELECTRICAL POWER CONTACT WITH TWO ADJACENT CONTACT BLADES ABUTTING EACH OTHER

CROSS-REFERENCE TO RELATED APPLICATIONS

This application is the National Stage of International Application No. PCT/US2014/025437, filed Mar. 13, 2014, which claims the benefit of U.S. application No. 61/784,506, filed Mar. 14, 2013, the disclosures of which are incorporated herein by reference in their entireties.

BACKGROUND

Electrical connectors and contacts often are designed in light of competing interests. For instance, an increase in power transmission capabilities can compete with dimensional constraints and undesirable heat buildup. Thus, power connectors can be difficult to reduce in size without reducing heat dissipation capabilities. Further, power connectors often provide minimal flexibility to comply with mating and mounting tolerances.

SUMMARY

In accordance with one embodiment, an electrical contact is configured to mate with a complementary electrical contact along a first direction. The electrical contact can include a mounting portion configured to electrically connect to a substrate, and a mating portion that extends along a forward direction with respect to the mounting portion. The mating portion is configured to mate with the complementary electrical power contact. The mating portion includes first and second contact blades that are disposed adjacent each other and can abut each other along a second direction that is substantially perpendicular to the forward direction. The first contact blade defines a first forwardmost tip, and the second contact blades defines a second forwardmost tip. The electrical contact can further include an intermediate portion that extends between the mating portion and the mounting portion, the intermediate portion configured to transmit electrical current between the mating portion and the mounting portion. A select portion of the power contact is configured to elastically angulate with respect to at least a portion of the mounting portion within a range that causes the first and second forwardmost tips to deflect a distance between approximately 0.25 mm and approximately 3 mm in the second direction, such that at least one of the first and second contact blades slides along the other of the first and second contact blades.

DETAILED DESCRIPTION

Figure 1:
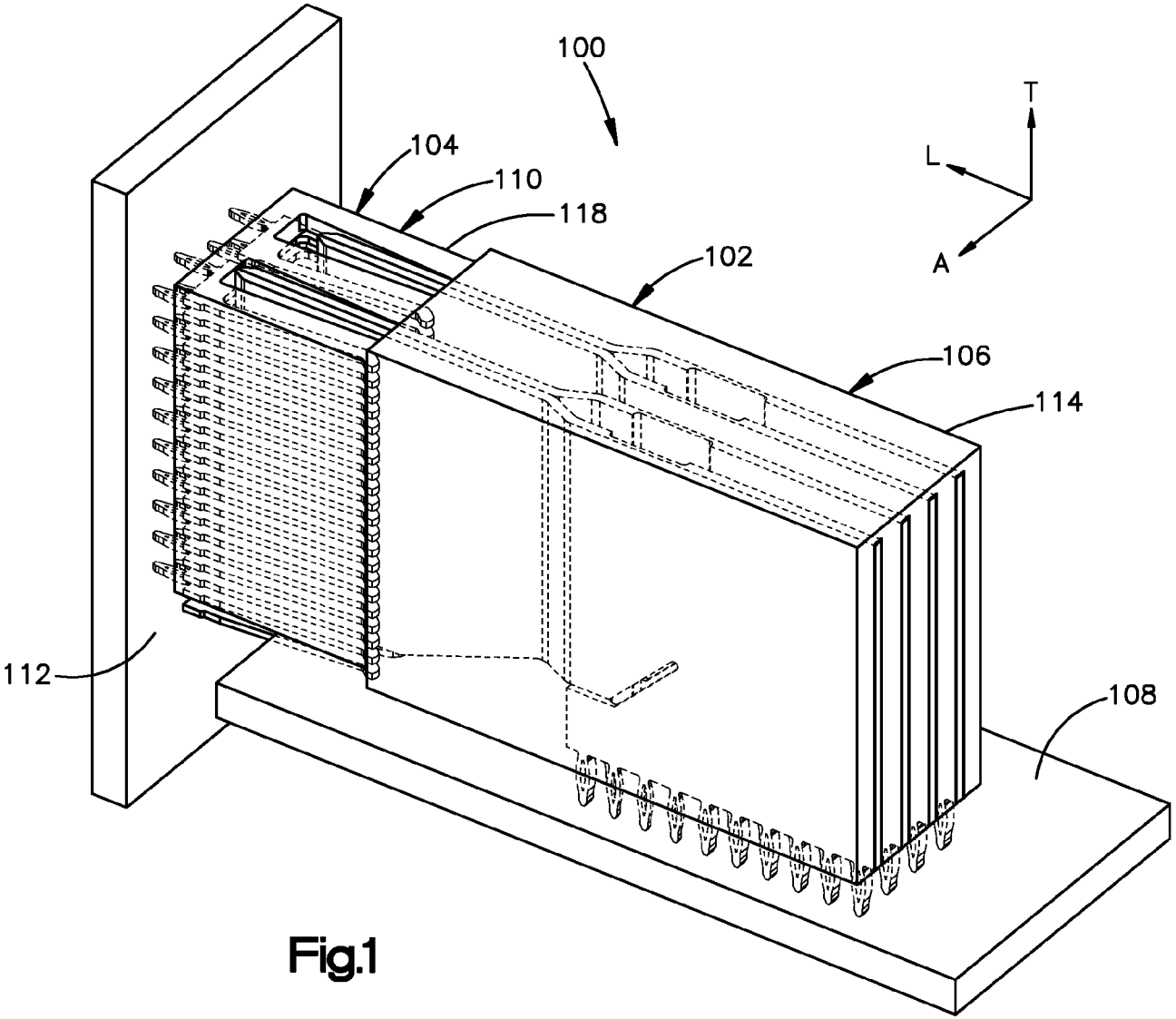
FIG. 1 is a perspective view of an electrical connector system constructed in accordance with one embodiment including a first electrical connector assembly that includes a right-angle header power connector mounted to an underlying substrate and a second electrical assembly that includes a vertical receptacle power connector mounted to an underlying substrate, whereby the first electrical connector assembly is mated with the second electrical connector assembly.

For convenience, the same or equivalent elements in the various embodiments illustrated in the drawings have been identified with the same reference numerals. Certain terminology is used in the following description for convenience only and is not limiting. The words "left," "right," "front," "rear," "upper," and "lower" designate directions in the drawings to which reference is made. The words "forward," "forwardly," "rearward," "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Referring initially to FIG. 1, in accordance with one embodiment, an electrical connector system 100 can include a first electrical connector assembly 102 that is configured to be mated with a second or complementary electrical connector assembly 104. The electrical connector assembly 102 can include a first power connector 106 and a first electrical component such as a first substrate 108, and the complementary electrical assembly 104 can include a second or complementary power connector 110 and a second electrical component such as a second substrate 112. The power connectors 106 and 110 can be configured to be mated with each other so as to establish an electrical connection, for instance an electrical connection that transfers electrical power, between the connectors 106 and 110, and thus between the first and complementary connector assemblies 102 and 104, respectively. The power connector 106 can be configured to be mounted to the substrate 108 and the complementary power connector 110 can be configured to be mounted to the substrate 112 so as to establish an electrical connection between substrates 108 and 112. The substrates 108 and 112 can be provided as a backplane, midplane, daughtercard, or the like.

Figure 2:
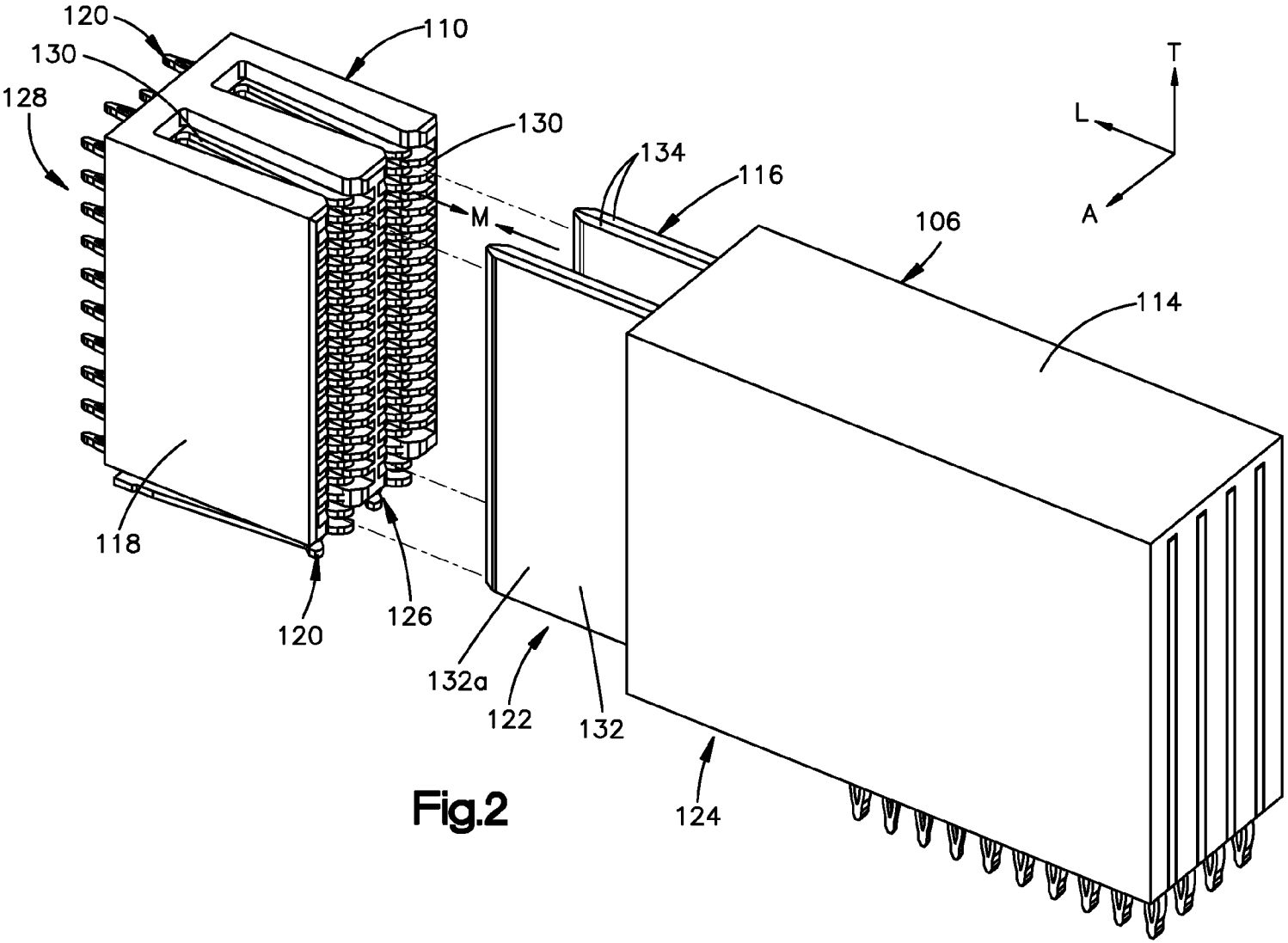
FIG. 2 is an exploded perspective view of the power connectors illustrated in FIG. 1, showing the power connectors in an unmated position and aligned for mating.
Figure 3:
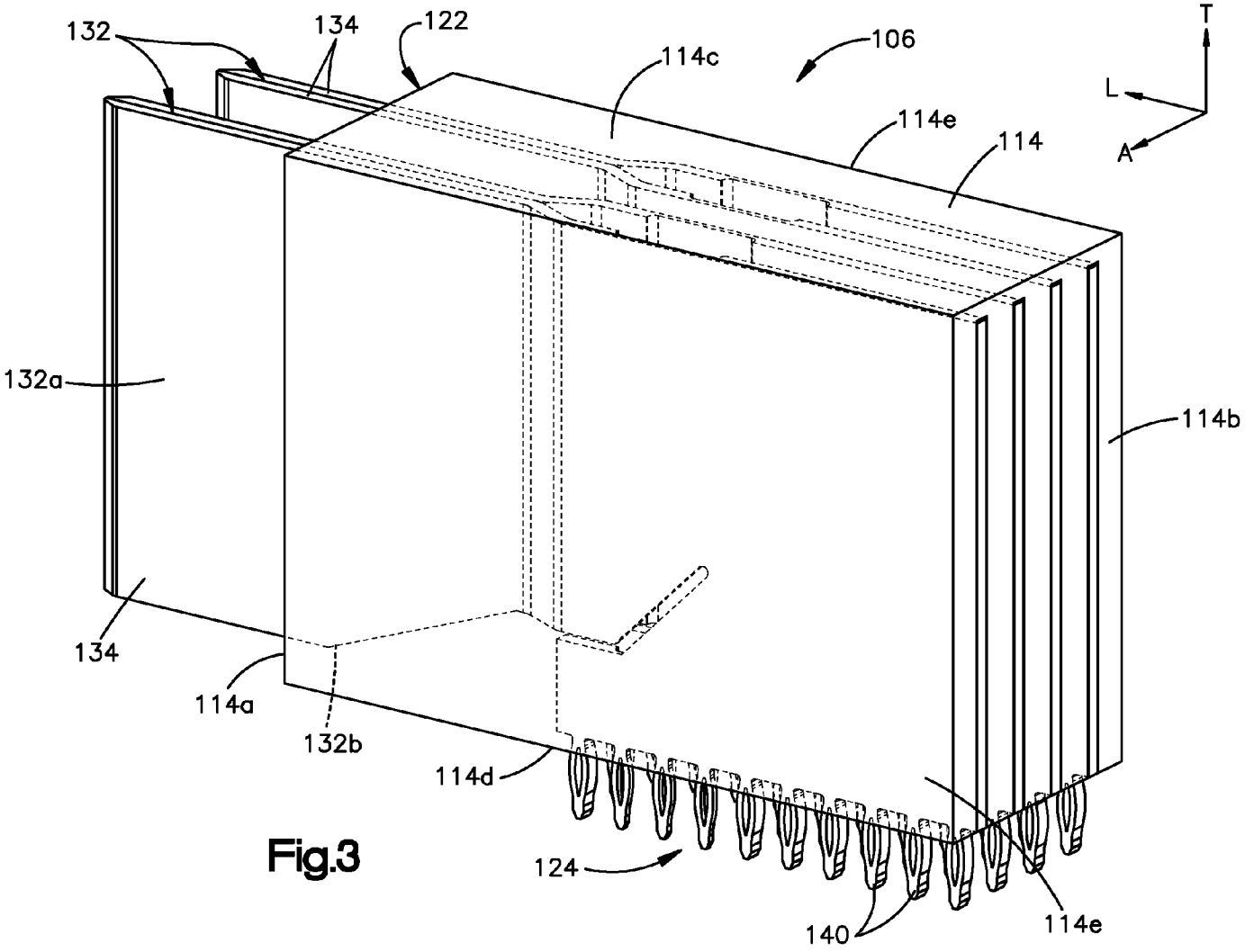
FIG. 3 is a perspective view of the power connector of the first electrical connector assembly illustrated in FIG. 1.
Figure 4:
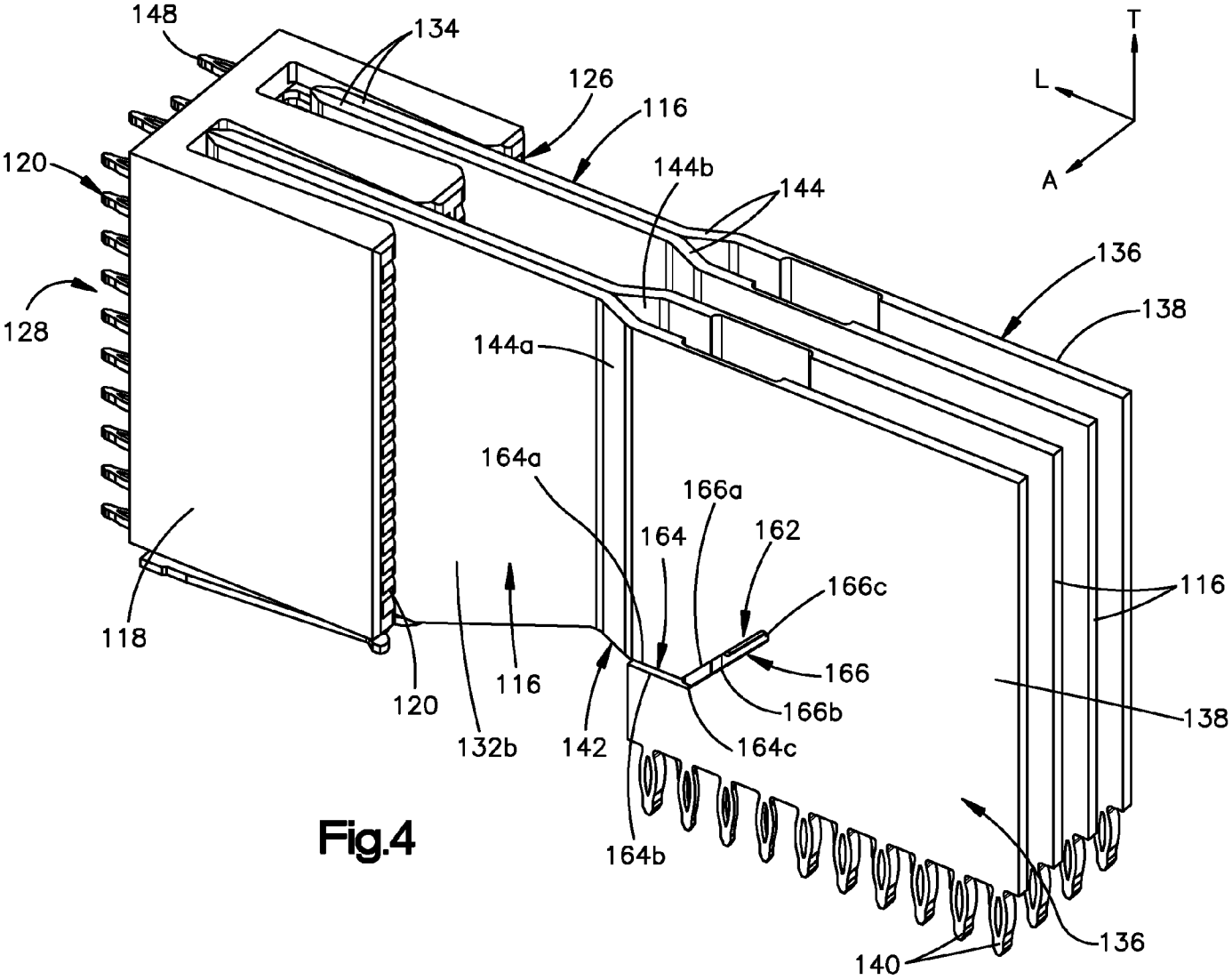
FIG. 4 is a perspective view of a portion of the power connectors illustrated in FIG. 1, showing electrical contacts of the first electrical connector assembly in a mated position with the power connector of the second electrical connector assembly.

Referring also to FIGS. 2-4, the power connector 106 can include a first dielectric or electrically insulative connector housing 114 and at least one such as a plurality of first electrical contacts 116 that are at least partially disposed within the connector housing 114. The electrical contacts 116 can be configured as electrical power contacts that are configured to transmit electrical current between the substrate 108 and the complementary power connector 110. When the power connector 106 is mounted to the substrate 108 along a mounting direction, the electrical contacts 116 are placed in electrical communication with electrical traces of the substrate 108. The complementary power connector 110 can include a second dielectric or electrically insulative connector housing 118 and at least one such as a plurality of second or complementary electrical contacts 120 that are supported by the connector housing 118 (see also FIG. 5). When the complementary power connector 110 is mounted to the substrate 112, the electrical contacts 120 are placed in electrical communication with electrical traces of the substrate 112. The power connector 106 can be configured to mate with the complementary power connector 110 so as to establish an electrical connection between the first and second electrical contacts 116 and 120, respectively, and thus also between the electrical traces of the substrates 108 and 112.

In accordance with the illustrated embodiment, the power connector 106 can be constructed as a right-angle header connector that includes the connector housing 114. The connector housing 114 defines a first mounting interface 124 and a first mating interface 122 that is oriented perpendicular with respect to the mounting interface 124. It will be understood that the power connector 106 can be constructed as desired, for instance as a vertical connector such that the mating interface 122 is parallel to the mounting interface 124. The mating interface 122 can be configured to be mated with the complementary power connector 110 and the mounting interface 124 can be configured to be mounted onto an electrical component. In accordance with the illustrated embodiment, the complementary power connector 110 can be constructed as a vertical receptacle connector that defines a second or complementary mating interface 126 and a second or complementary mounting interface 128 that extends substantially parallel to the complementary mating interface 126. The mating interface 122 of the power connector 106 can be configured to mate with the complementary mating interface 126 of the complementary power connector 110 that is to be mated with the power connector 106. The first and complementary mounting interfaces 124 and 128, respectively, can be configured to mount onto underlying substrates, such as the respective substrates 108 and 112. The mating interface 126 of the complementary power connector 110 can include receptacle slots 130 that are defined by the second connector housing 118, such that the electrical contacts 116 of the power connector 106 can be received in receptacle slots 130 when the power connector 106 is mated with the complementary power connector 110. As shown in the illustrated embodiment, the power connector 106 can be configured as a header connector and the complementary power connector 110 can be configured as a receptacle connector, such that the connector housing 118 is configured to receive the connector housing 114 so as to mate the first and complementary power connectors 106 and 110, respectively.

Various structures are described herein as extending horizontally along a first or longitudinal direction "L" and a second or lateral direction "A" that is substantially perpendicular to the longitudinal direction L, and vertically along a third or transverse direction "T" that is substantially perpendicular to the longitudinal and lateral directions L and A, respectively. As illustrated, the longitudinal direction "L" extends along a forward/rearward direction of the power connector 106, and defines a mating direction M along which one or both of the power connectors 106 and 110 are moved relative to the other so as to mate the connector assembly 102 with the complementary connector assembly 104, and thus to mate the power connector 106 with the complementary power connector 110. For instance, the mating direction M of the illustrated power connector 106 is in a forward direction along the longitudinal direction L, and the power connector 106 can be unmated from the complementary power connector 110 by moving the power connector 106 in an opposed longitudinally rearward direction relative to the complementary power connector 110. As illustrated, the power connector 106 can be moved relative to the substrate 108 along the transverse direction T that defines a first mounting direction, and the complementary power connector 110 can be moved relative to the substrate 112 along the longitudinal direction L to define a second mounting direction. As illustrated, the lateral direction A extends along a width of the power connector 106, and the longitudinal direction L extends along a length of the power connector 106.

Thus, unless otherwise specified herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector system 100 and its components as illustrated merely for the purposes of clarity and convenience, it being appreciated that these orientations may change during use.

With particular reference to FIG. 3, in accordance with the illustrated embodiment, the connector housing 114 can define a front end 114*a* and an opposed rear end 114*b* that is spaced from the front end 114*a* along the longitudinal direction L. The front end 114*a* can generally lie in a plane defined by the transverse and lateral directions T and A, respectively. The front end 114*a* can define the first mating interface 122 that is configured to be mated with the complementary power connector 110 as to place the power connector 106 in electrical communication with the complementary power connector 110. The connector housing 114, and thus the power connector 106, can further include a top end 114*c* and an opposed bottom end 114*d* that is spaced from the top end 114*c* along the transverse direction T. The bottom end 114*d* can define the mounting interface 124 that is configured to be mounted to the substrate 108. The bottom end 114*d* can generally lie in a plane defined by the longitudinal and lateral directions L and A, respectively. The connector housing 114, and thus the power connector 106, can further include first and second opposed sides 114*e* that are spaced from each other along the lateral direction A. While the lateral and longitudinal directions A and L, respectively, extend horizontally and the transverse direction T extends vertically in accordance with the illustrated orientation of the electrical connector system 100, it should be appreciated that the orientation of the electrical connector system can vary as desired.

The electrical contacts 116 of the power connector 106 can include respective mating portions 132 that are disposed proximate to the mating interface 122 and are configured to be electrically mated to a complementary electrical component, such as the electrical contacts 120 of the complementary power connector 110. The mating portion 132 can include a mating end 132*a* and a tapered end 132*b*. In accordance with the illustrated embodiment, the mating end 132*a* of the mating portion 132 extends forward from the front end 114*a* of the connector housing 114 along the longitudinal direction L, and the tapered end 132*b* extends rearward from the front end 114*a* of the connector housing. The electrical contacts 116 can be supported by the connector housing 114 such that the mating portion 132 extends out from the mating interface 122.

The electrical contact 116 can include a plurality of contact bodies, for instance a first contact body 116*a* and a second contact body 116*b*. Referring to the illustrated embodiment shown in FIGS. 3-8, the electrical contact includes two contact bodies, in particular the first contact body 116*a* and the second contact body 116*b* that is at least partially disposed against the first contact body 116*a* along the lateral direction A. Thus, the electrical contact 116 can be configured as a two part electrical contact that includes the first and second contact bodies 116*a* and 116*b*, respectively, that can be partially disposed against each other and abutting each other, for instance along the lateral direction A. The electrical contact 116 can be configured to include any number of contact bodies as desired. For instance, referring to the illustrated embodiment shown in FIGS. 11A-C, the electrical contact 116 is configured as a three part electrical contact that includes a third contact body 116*c* that is disposed between the first and second contact bodies 116*a* and 116*b* along the lateral direction A. The third contact body 116*c* can be partially disposed against the first and second contact bodies 116*a* and 116*b*. Alternatively, referring now to FIGS. 12A-C, the electrical contact 116 can be configured as a four part electrical contact that includes the first and second electrical contacts 116*a* and 116*b* spaced apart from each other along the lateral direction A. A plurality of contact bodies, for instance a fourth and a fifth contact body 116*d* and 116*e*, respectively, can be disposed between the first and second contact bodies 116*a* and 116*b* along the lateral direction A. In accordance with the illustrated embodiment, the fourth contact body 116*d* can be partially disposed against and abut the first and fifth contact bodies 116*a* and 116*e* along the lateral direction A, and the fifth contact body 116*e* can be partially disposed against and abut second contact body 116*b* and the fourth contact body 116*d* along the lateral direction A. It will be understood that the contact bodies can be alternatively arranged as desired.

The contact bodies 116*a-e* can include respective contact blades 134. For instance, referring again to FIGS. 3-8, the first contact body 116*a* can include a first contact blade 134*a* and the second contact body 116*b* can include a second contact blade 134*b* that can be disposed against and abut the first contact blade 134*a* along the lateral direction A that is substantially perpendicular to the longitudinal direction L. The first and second contact blades 134*a* and 134*b*, respectively, can define respective lengths along the longitudinal direction L. The first and second contact blades 134*a* and 134*b* define respective first and second forwardmost tips 141*a* and 141*b*. The first and second contact blades 134*a* and 134*b* can abut each other along the lateral direction A along entireties of their respective lengths in the longitudinal direction L. Alternatively, referring to FIGS. 11A-C, the third contact body 116*c* can include a third contact blade 134*c* that can be disposed between the first contact blade 134*a* and the second contact blade 134*b* along the lateral direction A. For instance, the third contact blade 134*c* can be disposed against and abut the first and second contact blades 134*a* and 134*b* along the lateral direction A. Referring to FIGS. 12A-C, the fourth and fifth contact bodies 116*d* and 116*e* can include fourth and fifth contact blades 134*d* and 134*e*, respectively, that are disposed between the first and second contact blades 134*a* and 134*b* along the lateral direction A. For instance, the fourth contact blade 134*b* can be disposed between and first and fifth contact blades 134*a* and 134*e* along the lateral direction A, and the fifth contact body blade 134*e* can be disposed between and against the second contact blade 134*b* and the fourth contact blade 134*d* along the lateral direction A. It will be understood that the contact blades can be alternatively arranged as desired.

Each of the contact blades 134 furthers define a top surface 143*a* and a bottom surface 143*b* spaced from the top surface 143*a* along the transverse direction T. The forwardmost tip of each of the contact blades 134 can define a continuous edge that is uninterrupted along as it extends along the transverse direction T from the top surface 143*a* to the bottom surface 143*b*. Further, an entirety of the forwardmost tips along the transverse direction from the top surface 143*a* to the bottom surface 143*b* defines a header that is configured to plug into the complementary receptacle contact.

Referring to FIGS. 3-8 and 11A-12C, the mating portion 132 of the electrical contact 116 can include the contact blades 134, for instance the first and second contact blades 134*a* and 134*b*. Each of the contact blades 134 of one electrical contact 116 can be slidable with respect to any of the other contact blades 134 of the electrical contact 116 along the longitudinal direction L. For instance, at least one of the first and second contact blades 134*a* and 134*b*, for instance both, can be slidable with respect to the other of the first and second contact blades 134*a* and 134*b* along the longitudinal direction L. By way of further example, referring to FIGS. 11A-C, the first contact blade 134*a* can be slidable with respect to the second and third contact blades 134*b* and 134*c* along the longitudinal direction L, and the second contact blade 134*b* can be slidable with respect to the first and third contact blades 134*a* and 134*c* along the longitudinal direction L. Thus, the third contact blade 134*c* can be slidable with respect to the first and second contact blades 134*a* and 134*b* along the longitudinal direction L. By way of yet another example, referring to FIGS. 12A-C, the first contact blade 134*a* can be slidable with respect to second, fourth, and fifth contact blades 134*b*, 134*d*, and 134*e* along the longitudinal direction L. The second contact blade 134*b* can be slidable with respect to the first, fourth, and fifth contact blades 134*a*, 134*d*, and 134*e* along the longitudinal direction L. Further, the fourth contact blade 134*d* can be slidable with respect to the first, second, and fifth contact blades 134*a*, 134*b*, and 134*e* along the longitudinal direction L, and the fifth contact blade

134*e* can be slidable with respect to the first, second, and fourth contact blades 134*a*, 134*b* and 134*d* along the longitudinal direction L.

The contact bodies, and thus the electrical contact 116, can be supported by the connector housing 114 such that select contact bodies are disposed against each other in the lateral direction A. Alternatively, it will be understood that the contact bodies can be attached to each other as desired. For instance, referring to FIGS. 3-8, the first and second contact bodies 116*a* and 116*b* can be supported by the connector housing 114 such that the first and second contact bodies 116*a* and 116*b*, and in particular the first and second contact blades 134*a* and 134*b*, are disposed against each other in the lateral direction A.

Referring generally to FIGS. 3-12C, in accordance with the illustrated embodiments, each of the electrical contacts 116 of the power connector 106 can further include a mounting portion 136 such that the mating portion 132 extends along the forward direction with respect to the mounting portion 136. The mounting portions 136 extend out from the mounting interface 124, and are configured to electrically connect to the substrate 108. The mounting portion 136 of the electrical contact 116 can include one or more plate members 138, for instance first and second plate members 138*a* and 138*b*, respectively, that are spaced apart from each other along the lateral direction A. While the illustrated plate members 138 are planar, it will be understood that the shape of the plate members can vary as desired. The mounting portion 136 can further include mounting tails 140 that are disposed proximate to the mounting interface 124. In accordance with the illustrated embodiment, each of the mounting tails 140 can extend from one of the plate members 138 along the transverse direction T. The first contact body 116*a* can include the first plate member 138*a* and the second contact body 116*b* can include the second plate member 138*b*. Further, the third contact body 116*c* can include a third plate member 138*c*. Similarly, the fourth contact body 116*d* can include a fourth plate member 138*d*. Similarly, the fifth contact body 116*e* can include a fifth plate member 138*e*. The mounting tails 140 that extend from the plate members 138, for instance the first and second plate members 138*a* and 138*b*, can be configured to be mounted to the underlying substrate 108 and can be configured to electrically connect to the substrate 108. For instance, the mounting tails 140 can be press-fit tails and can be configured to be inserted, or press-fit, into respective vias of the substrate 108, thereby electrically connecting the mounting portions 136 and the corresponding electrical contacts 116 to respective electrical traces of the substrate 108 when the power connector 106 is mounted to the substrate 108. The mounting tails 140 can be elongate along the transverse direction T. The vias can be configured as plated through-holes that electrically connect the mounting portions 136 to respective electrical traces of the underlying substrate 108. While the illustrated mounting tails 140 shown in FIGS. 1-10 are configured as press-fit tails, it should be appreciated that the mounting tails 140 can be configured to be placed in electrical communication with electrical traces of the substrate 108 in accordance with any suitable alternative embodiment (e.g., see FIGS. 11A-12C). For instance, the mounting tails can be surface mounted and configured to be fused, for instance soldered, to complementary contact pads of the substrate 108.

Each electrical contact 116 can further include an intermediate portion 142 that extends between the mating portion 132 and the mounting portion 136. Thus, the respective lengths of the first and second contact blades 134*a* and 134*b* can be defined from the intermediate portion 142 to the respective first and second forwardmost tips. In particular, the intermediate portion 142 can extend from the plate members 138 to the tapered end 132*b* of the mating portion 132. Thus, intermediate portion can be configured to transmit electrical current between the mating portion 132 and mounting portion 136. The intermediate portion 142 can include one or more necks 144, for instance first and second necks 144*a* and 144*b*, that extend between the contact blades 134 and the plate members 138. For instance, the first and second necks 144*a* and 144*b* can be tapered between the first and second contact blades 134*a* and 134*b* and the first and second plate members 138, respectively. The first contact body 116*a* can include the first contact blade 134*a*, the first plate member 138*a*, and the first neck 144*a* that connects the first contact blade 134*a* with the first plate member 138*a*. The second contact body 116*b* can include the second contact blade 134*b*, the second plate member 138*b*, and the second neck 144*b* that connects the second contact blade 134*b* with the second plate member 138*b*. In accordance with the illustrated embodiment, the intermediate portion 142 defines the first neck 144*a* that extends from the first plate member 134*a* to the first contact blade, and the second neck 144*b* that extends from the second plate member 138*b* to the second contact blade 134*b*, such that the first and second necks 144*a* and 144*b* are tapered toward each other as they extend from the mounting portion 136 toward the mating portion 132. Each of the first and second necks 144*a* and 144*b* can be tapered toward the other of the first and second necks 144*a* and 144*b* as the first and second necks 144*a* and 144*b* extend from the mounting portion 136 toward the mating portion 132.

Figure 11A:
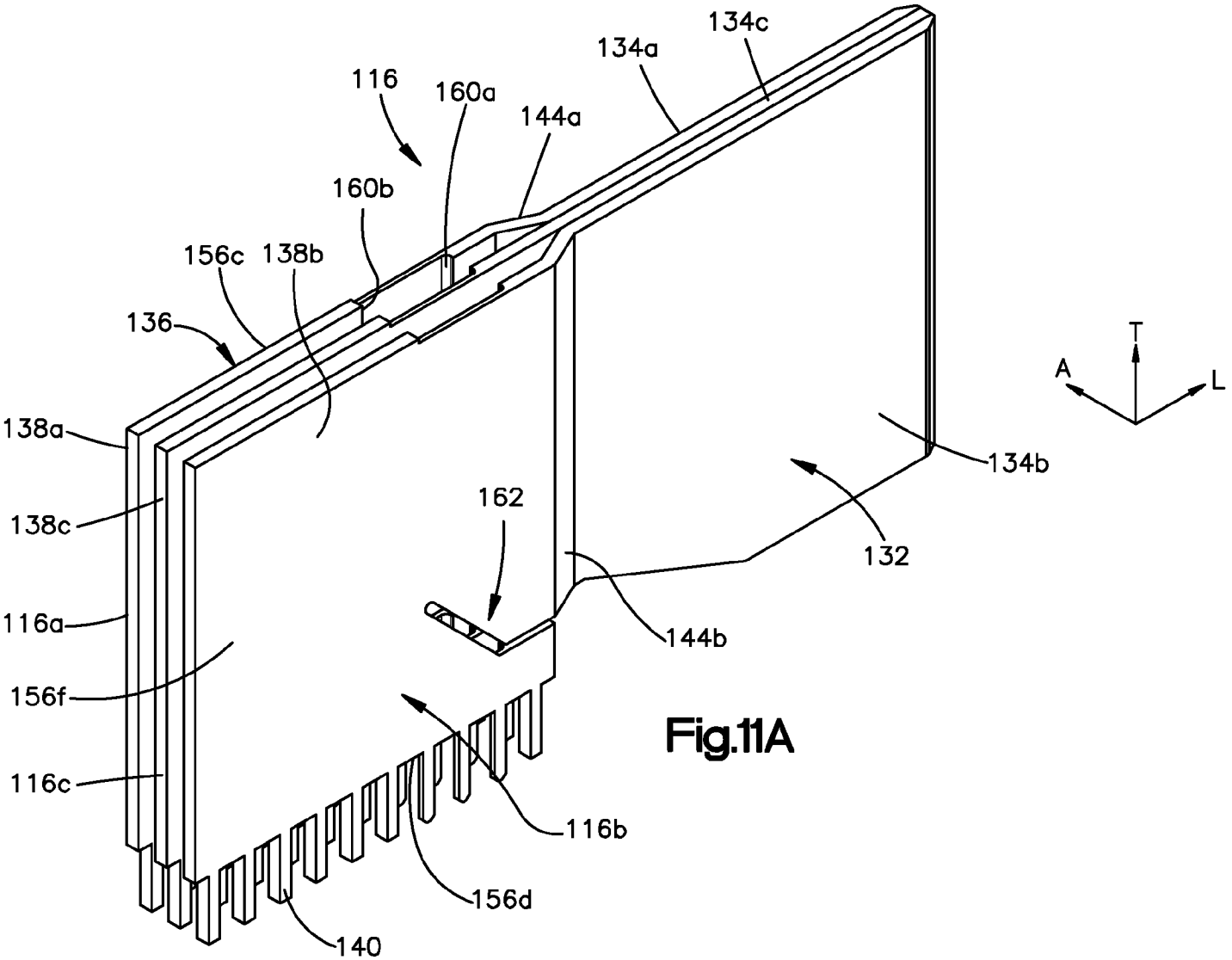
FIG. 11A is a perspective view of an electrical contact constructed in accordance with another embodiment, wherein the electrical contact includes three contact bodies and can be included in the power connector shown in FIG. 3.
Figure 11B:
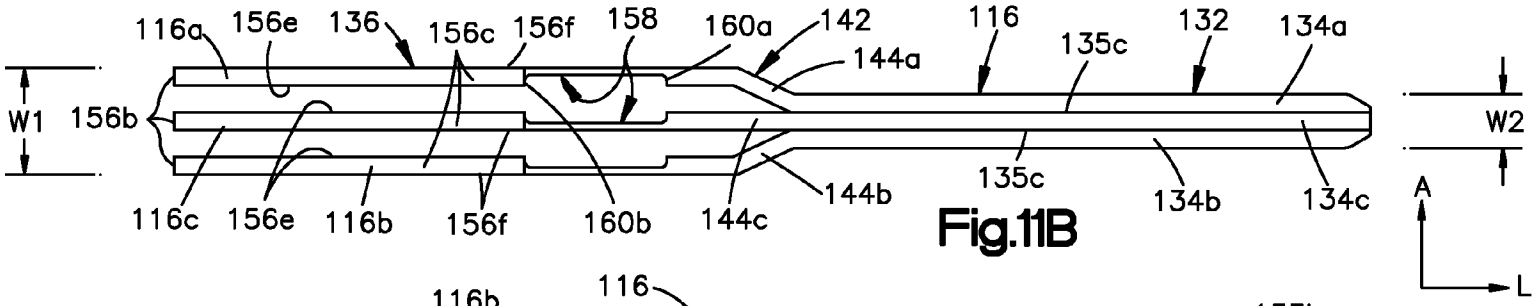
FIG. 11B is a top plan view of the electrical contact shown in FIG. 11A.
Figure 11C:
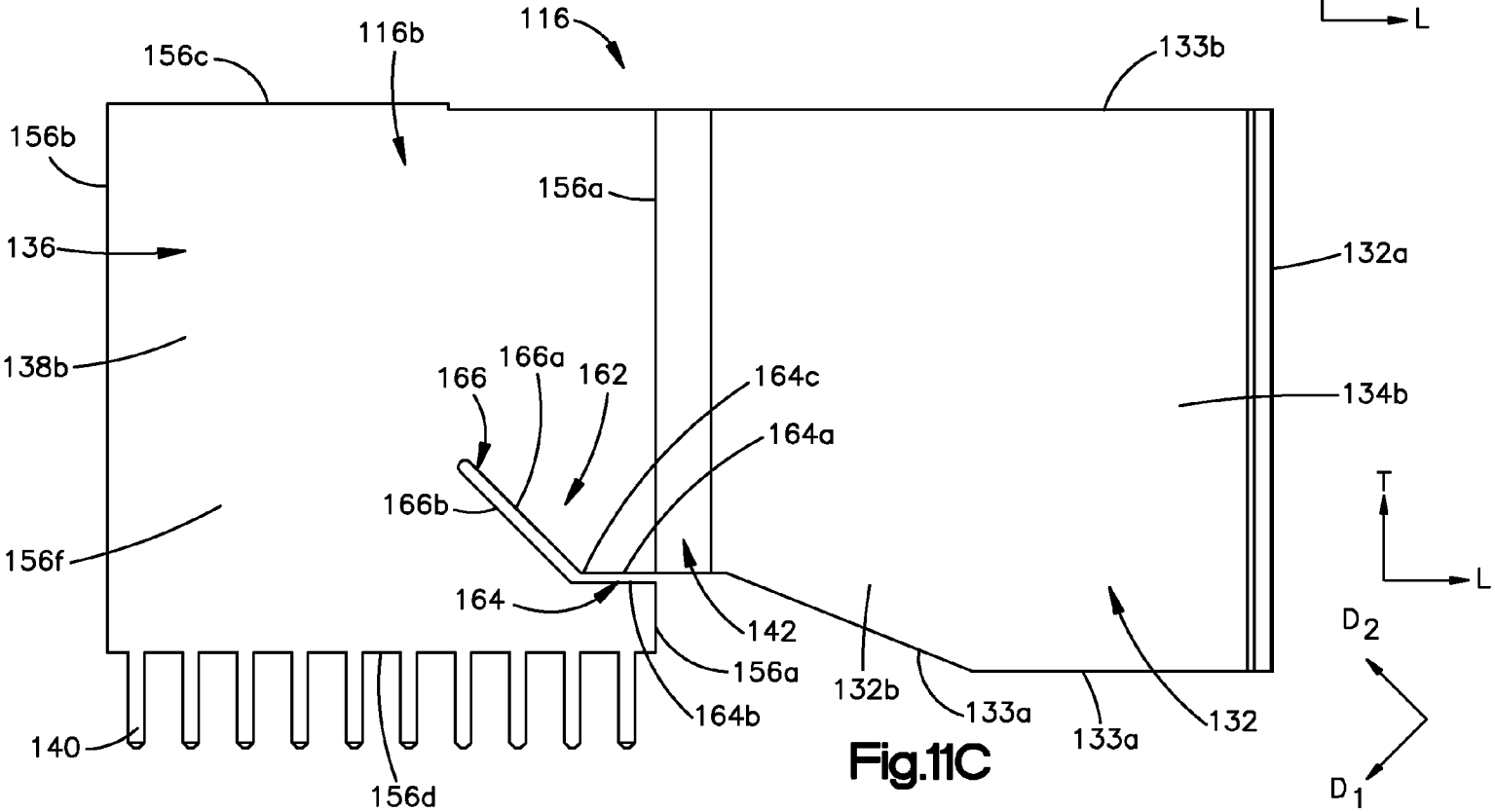
FIG. 11C is a side elevation view of the electrical contact shown in FIGS. 11A and 11B.
Figure 12A:
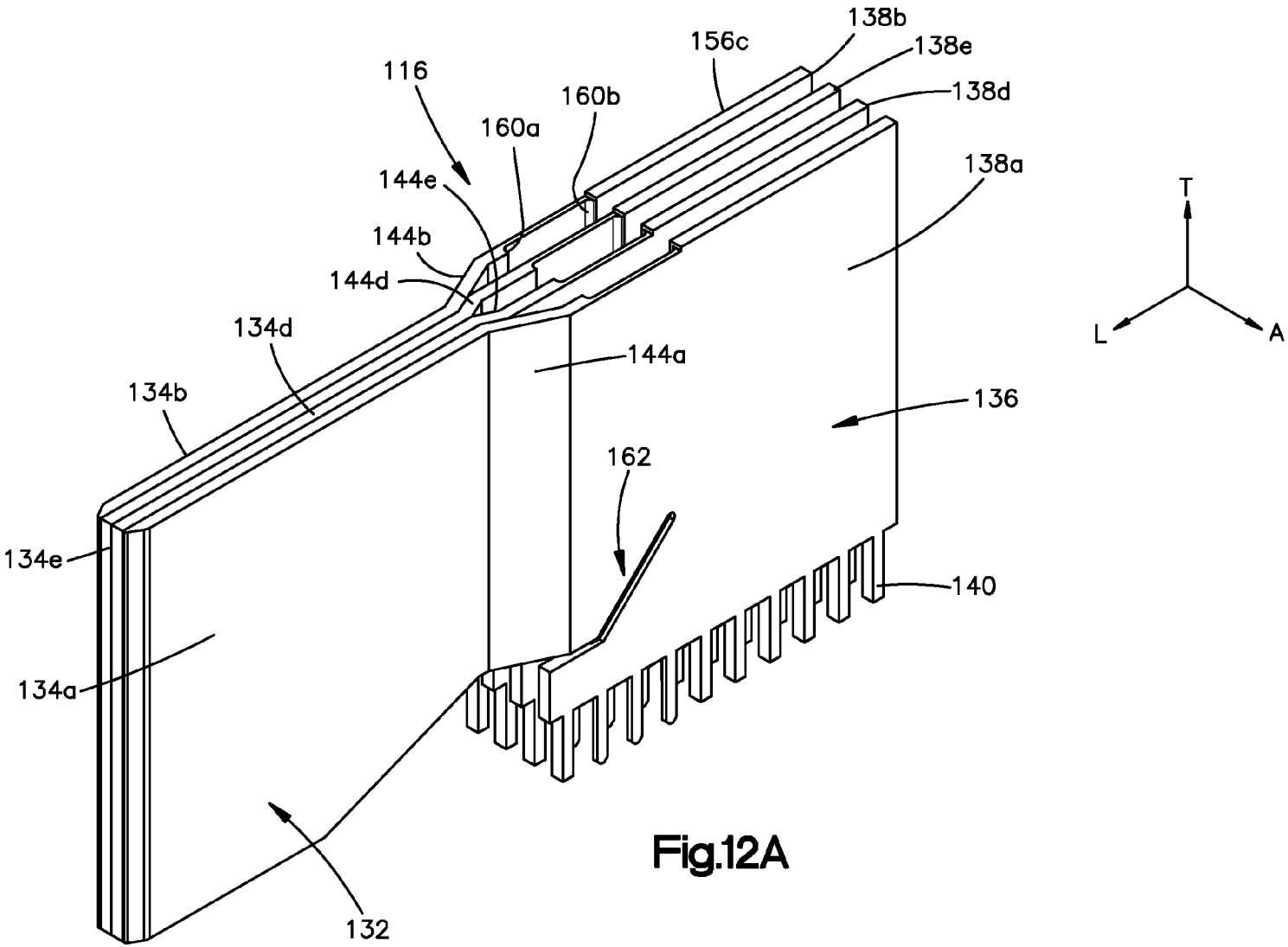
FIG. 12A is a perspective view of an electrical contact constructed in accordance with yet another embodiment, wherein the electrical contact includes four contact bodies and can be included in the power connector shown in FIG. 3.
Figure 12B:
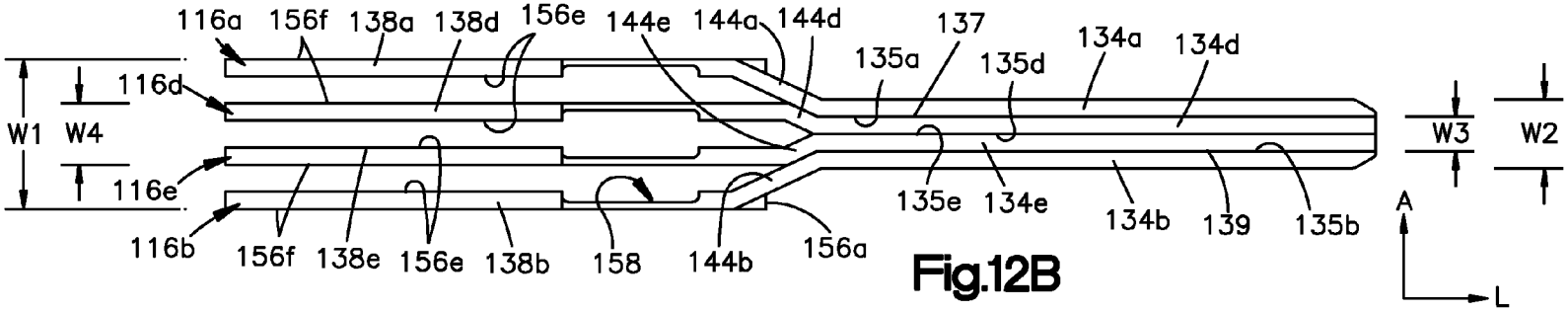
FIG. 12B is a top plan view of the electrical contact shown in FIG. 12A.
Figure 12C:
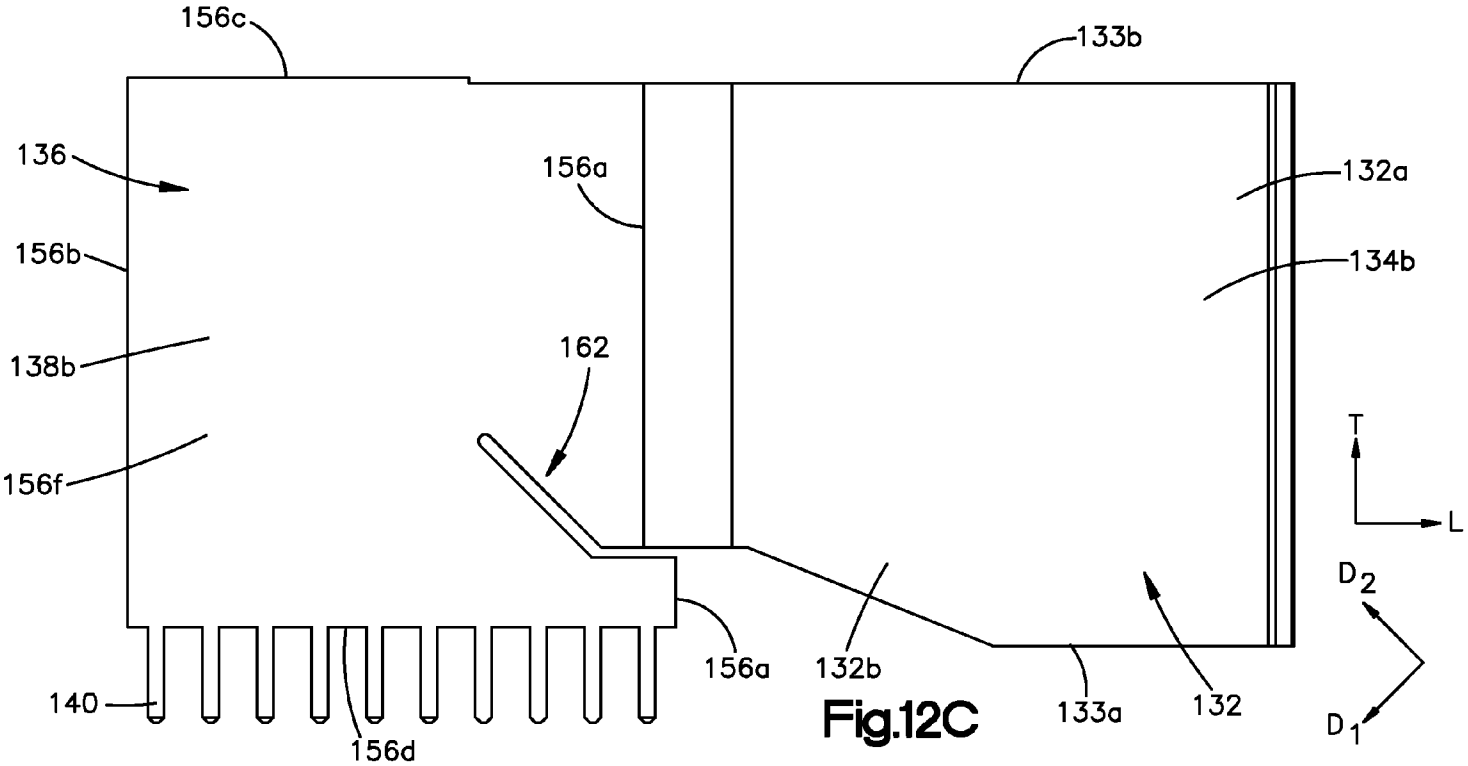
FIG. 12C is a side elevation view of the electrical contact shown in FIGS. 12A and 12B.

Referring to FIGS. 11A-C, in accordance with the illustrated embodiment, the intermediate portion 142 can include the first and second necks that 144*a* and 144*b* that are tapered, and the intermediate portion 142 can further include a third neck 144*c* that generally lies in a plane defined by the longitudinal and transverse directions L and T, respectively. The third neck 144*c* can extend between the third contact blade 134*c* the third plate member 138*c*. Thus, third contact body 116*c* can include the third contact blade 134*c*, the third plate member 138*c*, and the third neck 144*c* that connects the third contact blade 134*c* with the third plate member 138*c*.

Referring to FIGS. 12A-C, in accordance with the illustrated embodiment, the intermediate portion 142 can include the first and second necks 144*a* and 144*b* that are tapered, and the intermediate portion 142 can further include fourth and fifth necks 144*d* and 144*e* that can be tapered between the fourth and fifth contact blades 134*d* and 134*d* and the fourth and fifth plate members 138*d* and 138*d*, respectively. Thus, the fourth contact body 116*d* can include the fourth contact blade 134*d*, the fourth plate member 138*d*, and the fourth neck 144*d* that connects the fourth contact blade 134*d* with the fourth plate member 138*d*. The fifth contact body 116*e* can include the fifth contact blade 134*e*, the fifth plate member 138*e*, and the fifth neck 144*e* that connects the fifth contact blade 134*e* with the fifth plate member 138*e*.

The contact blades 134 can define respective lengths along the longitudinal direction L. For instance, the entire lengths of each of the contact blades 134 can be equal to the distance from the respective necks 144 in the forwardly longitudinal direction to the terminal end of the mating end 132*a* of the respective contact blade 134. The lengths of the contact blades 134 of a given electrical contact 116 can be substantially equal to each other. The lengths of the contact blades of at least one electrical contact 116 can be different, for instance shorter or longer, than the lengths of the contact blades 134 of at least one other electrical contact of the same power connector 110 (see FIGS. 6 and 7). It will be understood that the lengths of the contact blades 134, and thus the electrical contacts 116, in the power connector 106 can vary as desired along the longitudinal direction L. Further, in accordance with the illustrated embodiments, the contact blades 134 of a select electrical contact 116 can abut each other along the lateral direction A along entireties of their respective lengths in the longitudinal direction L. Referring to FIGS. 3-8, in accordance with the illustrated embodiment, the first and second contact blades 134*a* and 134*b*, respectively, can abut each other along the lateral direction A along entireties of their respective lengths in the longitudinal direction L. Referring to FIGS. 11A-C, the third contact blade 134*c* can abut the first and second contact blades 134*a* and 134 along the lateral direction A along entireties of the lengths of the first and second contact blades 134*a* and 134*b* in the longitudinal direction L. Referring to FIGS. 12A-C, in accordance with the illustrated embodiment, the first and fourth contact blades 134*a* and 134*d*, respectively, can abut each other along the lateral direction A along entireties of their respective lengths in the longitudinal direction L. Further, the second and fifth contact blades 134*b* and 134*e*, respectively, can abut each other along the lateral direction A along entireties of their respective lengths in the longitudinal direction L, and the fourth and fifth contact blades 134*d* and 134*e*, respectively, can abut each other along the lateral direction A along entireties of their respective lengths in the longitudinal direction L.

The first and second necks 144*a* and 144*b* of a respective electrical contact 116 can extend away rearwardly along the longitudinal direction L such that the respective first and second plate members 138*a* and 138*b* of the electrical contact 116 are spaced apart from each other a distance along the lateral direction A that is greater than the distance the respective first and second contact blades 134*a* and 134*b* of the electrical contact 116 are spaced apart from each other along the lateral direction A. Thus, the mounting portion 136 can define a first width $W_1$ (see FIGS. 7, 11B, and 12B) along the lateral direction A and the mating portion 132 can define a second width $W_2$ (see FIGS. 7, 11B, and 12B) along the lateral direction A that is less than the first width $W_1$. The mounting portion 136 can include the first and second plate members 138*a* and 138*b* that are spaced apart from each other along the lateral direction A so as to define the first width $W_1$. In particular, in accordance with the illustrated embodiments, the first and second plate members 138*a* and 138*b* each have inner surfaces 156*e* that face each other and respective outer surfaces 156*f* that face away from each other, and the mounting portion 136 can define the first width $W_1$ from the outer surface 156*f* of the first plate member 138*a* to the outer surface 156*f* of the second plate member 138*b* along the lateral direction A. Further, in accordance with the illustrated embodiments, the mating portion 132 includes the first contact blade 134*a* that includes a first inner broad surface 135*a*, and the second contact blade 134*b* that includes a second inner broad surface 135*b*. Thus, the first and second contact blades 134*a* each have inner broad surfaces that face each other and respective outer broad surfaces that face away from each other, and the mating portion 132 can define the second width $W_2$ from the outer broad surface of the first contact blade 134*a* to the outer broad surface of the second contact blade 134*b* along the lateral direction A.

Figure 7:
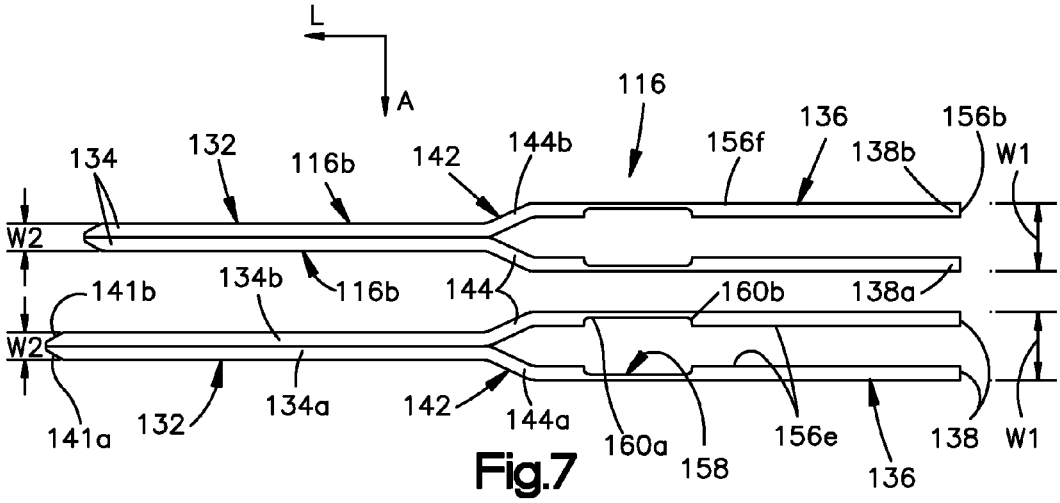
FIG. 7 is a top plan view of the electrical contacts of the power connector illustrated in FIG. 3.

Referring to FIGS. 11B and 12B, the first and second widths $W_1$ and $W_2$ can be increased, as compared to the first and second widths of the electrical contact 116 shown in FIG. 7 that only includes the first and second contact bodies 116*a* and 116*b*, when one or more contact bodies are disposed between the other contact bodies, for instance the first and second contact bodies 116*a* and 116*b*, along the lateral direction A. It will be understood that the electrical contact can be constructed such that the first and second widths $W_1$ and $W_2$ can vary as desired.

Referring to FIG. 12B, the fourth and fifth necks 144*d* and 144*e* of a respective electrical contact 116 can extend away rearwardly along the longitudinal direction L such that the respective fourth and fifth plate members 138*d* and 138*e* of the electrical contact 116 are spaced apart from each other a distance along the lateral direction A that is greater than the distance the respective contact blades 134*a* and 134*b* of the electrical contact 116 are spaced apart from each other along the lateral direction A. Thus, the mounting portion 136 can define a third width $W_3$ along the lateral direction A and the mating portion 132 can define a fourth width $W_4$ (see FIGS. 7, 11B, and 12B) along the lateral direction A that is less than the third width $W_3$, and the mounting portion 136 can include the fourth and fifth plate members 138*d* and 138*e* that are spaced apart from each other along the lateral direction A so as to define the third width $W_3$. In accordance with the illustrated embodiment, the third width $W_3$ can be less than the first width $W_1$ defined by the first and second plate members 138*a* and 138*b*, and the fourth width $W_4$ can be less than the second width $W_2$ defined by the first and second contact blades 134*a* and 134*b*.

The electrical contacts 116, including the contact blades 134, the necks 144, the plate members 138, and the mounting tails 140, can be made of any suitable electrically conductive material as desired, such as a copper alloy. The electrical contacts 116 can be sized to carry electrical communications or data signals, or to support DC and/or AC power.

The mounting tails 140 that extend from each of the plate members 138, for instance the first and second plate members 138*a* and 138*b*, are spaced substantially along the longitudinal direction L and extend downward from the plate members 138 along the transverse direction T. The contact blades 134, for instance the first and second contact blades 134*a* and 134*b*, of each respective mating portion 132 are spaced along the lateral direction A and extend forward from the front end 114*a* of the connector housing 114 along the longitudinal direction L that is substantially perpendicular to the lateral and transverse directions A and T, respectively. The power connector 106, for instance the connector housing 114, can include a dielectric material, such as air or plastic, that electrically isolates individual ones of the electrical contacts 116 from one another. The first contact blade 134*a* can include a first inner broad surface 135*a* and the second contact blade 134*b* can include a second inner broad surface 135*b* that faces the first inner broad surface 135*a*.

The third contact blade 134*c* can include opposed broad surfaces 135*c* that each face one of the first and second inner broad surfaces 135*a* and 135*b* of the first and second contact blades 134*a* and 134*b*, respectively. The fourth contact blade 134*d* can include a fourth inner broad surface 135*d* and the fifth contact blade 134*e* can include a fifth inner broad surface 135*e* that faces the fourth inner broad surface 135*d*. Thus, in accordance with the illustrated embodiment shown in FIGS. 12A-C, the fourth inner broad surface 135*d* can face the second inner broad surface 135*b*, and the fifth inner broad surface 135*e* can face the first inner broad surface 135*a*. The fourth contact blade 134*d* can further include an outer broad surface 137 opposite the fourth inner broad surface 135*d* along the lateral direction A, and the fifth contact blade 134*e* can further include an outer broad surface 139 opposite the fifth inner broad surface 135*e* along the lateral direction A. In accordance with the illustrated embodiment shown in FIGS. 12A-C, the outer broad surface 137 of the fourth contact blade 134*d* can face, for instance be disposed against, the first inner broad surface 135*a* of the first contact blade 134*a*. The outer broad surface 139 of the fifth contact blade 134*e* can face, for instance be disposed against, the second inner broad surface 135*b* of the second contact blade 134*b*.

The electrical contacts 116 can define plug or header type mating portions 132. Because the illustrated mating portions 132 of the electrical contacts 116 are configured as header type mating portions, the power connector 106 can be referred to as a plug or header type connector. Furthermore, because the first mating interface 122 is oriented substantially perpendicular to the first mounting interface 124, the power connector 106 can be referred to as a right angle connector, though it should be appreciated that the power connector 106 can alternatively be constructed in accordance with any desired configuration so as to electrically connect an underlying substrate, such as a printed circuit board, to a complementary electrical connector, such as the illustrated complementary power connector 110. For instance, the first power connector 106 can alternatively be constructed as a receptacle connector with electrical contacts 116 having receptacle type mating ends configured to receive spade or plug type mating ends of the electrical contacts of a complementary electrical connector, such as a vertical or a right-angle connector that is to be mated with the power connector 106. Additionally, the power connector 106 can be configured as a vertical connector, whereby the mating interface 122 is oriented substantially parallel with respect to the mounting interface 124.

Figure 5:
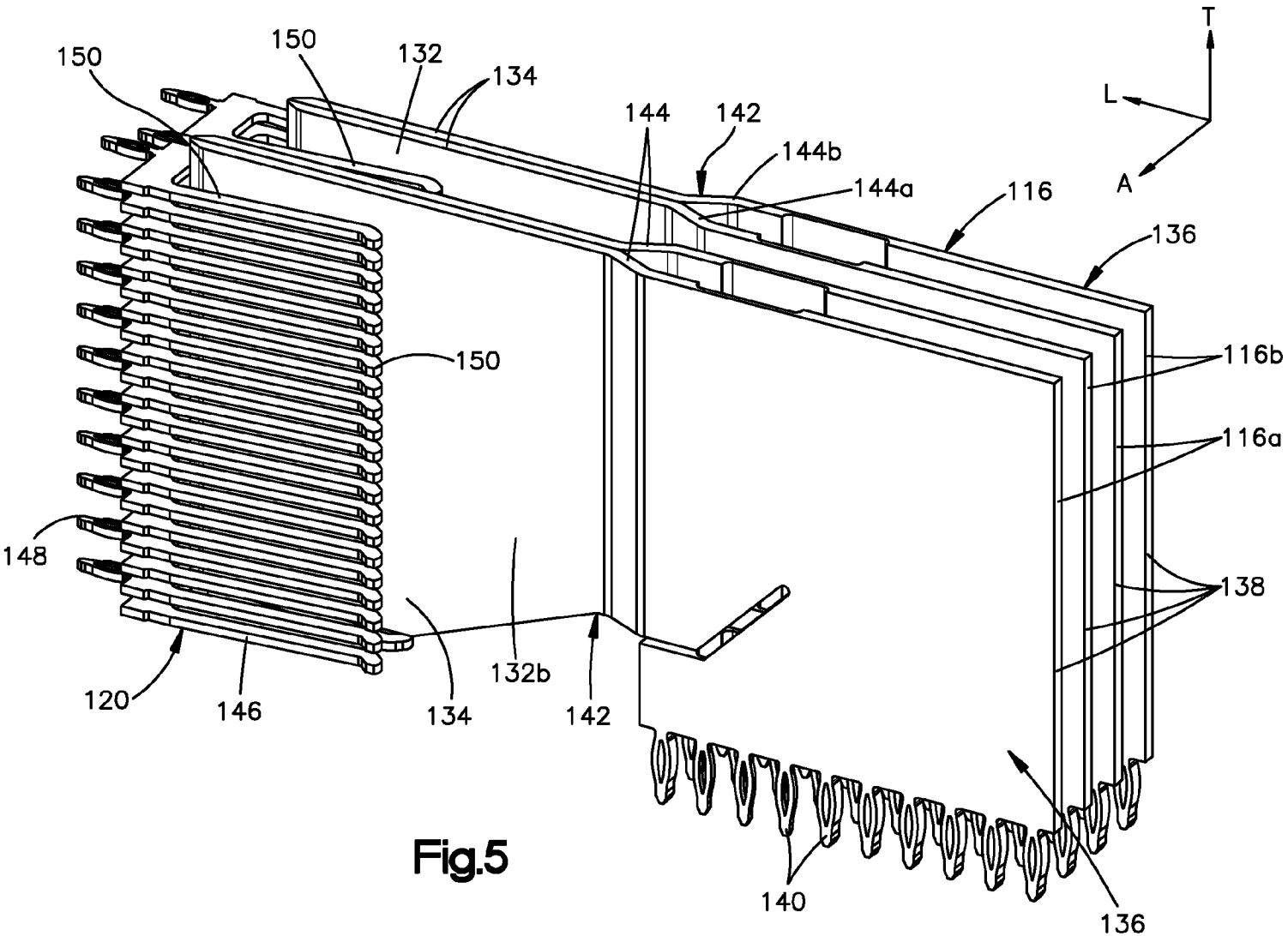
FIG. 5 is a perspective view of another portion of the power connectors illustrated in FIG. 1, showing the electrical contacts of the first electrical connector assembly in a mated position with electrical contacts of the second electrical connector assembly.
Figure 6:
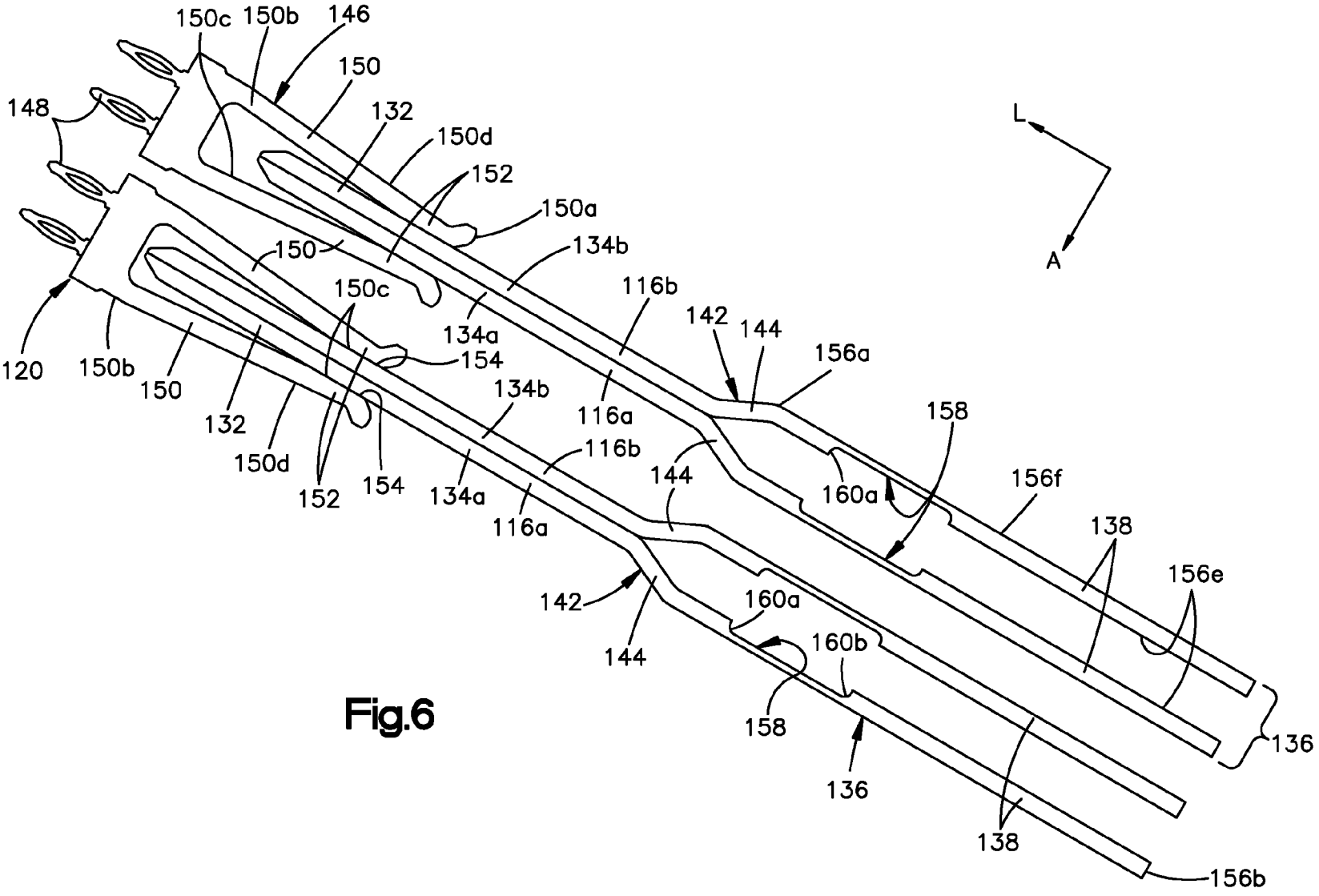
FIG. 6 is a top plan view of the mated electrical contacts illustrated in FIG. 5.

Referring to FIGS. 4-6, the complementary electrical contacts 120 of the complementary power connector 110 can define respective complementary mating portions 146 that are disposed proximate to the complementary mating interface 126, and are configured to be electrically mated to an electrical component, such as the first power connector 106. The mating portions 146 can be elongate along the mating direction M that is parallel to the mounting direction of the complementary power connector 110. The electrical contacts 120 can further define respective complementary mounting tails 148 that can be configured as press-fit tails, and that are disposed proximate to the mounting interface 128 and can be configured to be mounted to the complementary underlying substrate 112. For instance, the mounting tails 148 can be press-fit tails and can be configured to be inserted, or press-fit, into respective vias of the substrate 112, thereby electrically connecting the mounting tails 148 and the corresponding electrical contacts 120 to respective electrical traces of the substrate 112 when the complementary power connector 110 is mounted to the substrate 112. As illustrated, the mounting tails 148 can be elongate along the longitudinal direction L and can be elongate along substantially the same direction as the mating portions 146. While the mounting tails 148 of the electrical contacts 120 are configured as press-fit tails, it should be appreciated that the mounting tails can be configured to be placed in electrical communication with electrical traces of the substrate 112 in accordance with any suitable alternative embodiment. For instance, the mounting tails can be surface mounted and configured to be fused, for instance soldered, to complementary contact pads of the substrate 112.

With particular reference to FIGS. 5-6, in accordance with the illustrated embodiment, the respective complementary mating portions 146 of the complementary electrical contacts 120 are configured as receptacles that are configured to receive the respective mating portions 132 of the electrical contacts 116 of the first power connector 106 when the first and complementary power connectors 106 and 110 are mated, thereby establishing an electrical connection between the first and complementary power connectors 106 and 110, respectively. Thus, the mating portions 132 are configured to mate with respective mating portions 146 of the complementary electrical contacts 120. For instance, each of the mating portions 132, and thus each of the electrical contacts 120, can include a plurality of beams 150 that can be arranged in pairs 152 that are spaced apart from each other along the transverse direction T. The pair 152 can be referred to as first and second beams 150. Each beam 150 in a pair 152 can be spaced apart from the other beam 150 in the pair 152 a distance along the lateral direction A so as to receive the electrical contact 116. Each of the beams 150 can include a front end 150*a* and an opposed rear end 150*b* that is disposed proximate to the complementary mounting tails 148 and is spaced from the front end 150*a* along the longitudinal direction L. Each beam 150 can further include an inner side 150*c* and an opposed outer side 150*d* that is spaced apart from the inner side 150*c* along the lateral direction A that is substantially perpendicular to the mating direction M, such that the inner side 150*c* of one of the beams 150 in the respective pair 152 faces the inner side 150*c* of the other beam 150 in the pair 152.

In accordance with the illustrated embodiment, the front ends 150*a* of the beams 150 in respective pairs 152 can converge to define "pinching" or "receptacle" beams, such that the distance between the front ends 150*a* in the respective pair 152 along the lateral direction A is shorter than the distance between the rear ends 150*b* in the respective pair 152 along the lateral direction A. Thus, the pairs 152 of beams 150 can be geometrically configured as tuning forks. The inner sides 150*c* can define respective contact surfaces 154 that are configured to abut at least a portion of the first mating portion 132, and thus the first electrical contact 116, so as to place the complementary power connector 110 in electrical communication with the first power connector 106 when the power connectors 106 and 110 are mated with each other. For instance, when the mating portion 132 of the power connector 106 is mated with the mating portion 146 of the complementary power connector 110, the beams 150 can deflect, flex, or otherwise deviate from their biased position so as to engage the mating portion 132 of the power connector 106. Thus, when the power connector 106 is mated with the complementary power connector 110, the contact surfaces 154 of the beams 150 can define a mating force along the lateral direction A against the contact blades 134, for instance the first and second contact blades 134*a* and 134*b*, so as to press the first and second contact blades 134*a* and 134*b* toward, for instance against, each other. While the lateral and longitudinal directions A and L, respectively, extend horizontally and the transverse direction T extends vertically in accordance with the illustrated orientation of the electrical connector system 100, it should be appreciated that the orientation of the electrical connector system can vary as desired.

Because the mating portions 146 of the electrical contacts 120 are configured as receptacle type mating portions, the complementary power connector 110 can be referred to as a receptacle connector. Furthermore, because the complementary mating interface 126 is oriented substantially parallel to the complementary mounting interface 128, the complementary power connector 110 can be referred to as a vertical connector, though it should be appreciated that the power connector 110 can alternatively be constructed in accordance with any desired configuration so as to electrically connect an underlying substrate 112, such as a printed circuit board, to another electrical connector, such as the illustrated first power connector 106. For instance, the complementary power connector 110 can alternatively be constructed as a header type connector with electrical contacts 120 having plug or header type mating ends configured to plug into receptacle type mating ends of power connector that is to be mated with the power connector 110. Additionally, the power connector 110 can be configured as a right-angle connector, whereby the mating interface 126 is oriented substantially perpendicular with respect to the mounting interface 128.

Referring to FIGS. 6-12C, each of the plate members 138, for instance each of the first and second plate members 138*a* and 138*b* of the electrical contact 116 can define a front end 156*a* having at least a portion that extends from the intermediate portion 142 in a rearward direction that extends along the longitudinal direction L. Each of the plate members 138, for instance each of the first and second plate members 138*a* and 138*b*, can further define a rear surface 156*b* that is spaced from the front end 156*a* in the rearward direction. Thus, the mounting portion 136 of the electrical contact 116 can define the front ends 156*a* and the opposed rear surfaces 156*b* that are spaced from the front ends 156*a* along the longitudinal direction L. The plate members 138, for instance the first and second plate members 138*a* and 138*b*, can further include a respective top surface 156*c* and an opposed respective bottom surface 156*d* that is spaced from the top surface 156*c* along the transverse direction T. Thus, the mounting tails 140 that are each disposed proximate to the mounting interface 124 can each extend from the bottom surfaces 156*d* of the respective plate members 138 along the transverse direction T. The bottom surface 156*d* can generally lie in a plane defined by the longitudinal and lateral directions L and A, respectively. Alternatively, it will be understood that mounting tails 140 can extend from other surfaces as desired, such as from the rear surface 156*b* of the plate members 138.

A distance between the top surface 156*c* and the bottom surface 156*d* along the transverse direction T can define a height of the respective plate member 138. The height of a select plate member 138 can be substantially uniform along the longitudinal direction L. For instance, referring in particular to FIG. 8, the first and second plate members 138*a* and 138*b* can define respective heights that are substantially uniform along the longitudinal direction L. Alternatively, the height of at least one of the plate members 138 can vary as desired along the longitudinal direction L.

In accordance with the illustrated embodiments, the inner surface 156*e* of one of the first and second plate members 138*a* and 138*b* of the electrical contact 116 faces the inner surface 156*e* of the other plate member of the first and second plate members 138*a* and 138*b* in the respective electrical contact 116. The inner surfaces 156*e* of the plate members 138, for instance the first and second plate members 138*a* and 138*b*, can be spaced from each other along the lateral direction A. For instance, referring to FIGS. 12A-C, the inner surface 156*e* of one of the fourth and fifth plate members 138*d* and 138*e* faces the inner surface 156*e* of the other plate member of the fourth and fifth plate members 138*d* and 138*e*. Further, the inner surfaces 156*e* of the fourth plate member 156*d* and the fifth plate member 156*e* can be spaced from each other along the lateral direction A. While the lateral and longitudinal directions A and L, respectively, extend horizontally and the transverse direction T extends vertically in accordance with the illustrated orientation of the electrical connector system 100, it should be appreciated that the orientation of the electrical connector system can vary as desired.

In accordance with the illustrated embodiments, one or more of the plate members 138, for instance at least one of the first and second plate members 138*a* and 138*b* of the electrical contact 116, can define a recess 158 that extends into one of the respective inner and outer surfaces 156*e* and 156*f* toward the other of the respective inner and outer surfaces 156*e* and 156*f* along the lateral direction A. The recess 158 can terminate without extending through the other of the respective inner and outer surface 158*e* and 158*f* along the lateral direction A. In accordance with the illustrated embodiments, at least one, for instance all, of the plate members 138 can define respective recesses 158 that extend into one of the respective inner and outer surfaces 156*e* and 156*f* toward the other of the respective inner and outer surfaces 156*e* and 156*f* along the lateral direction A. The first plate member 138*a* can define a first recess 158 that extends into the inner and outer surfaces 158*e* and 158*f* of the first plate member 138*a* toward the other of the inner and outer surfaces 158*e* and 158*f* of the first plate member 138*a* along the lateral direction A. The second plate member 138*b* can define a second recess 158 that extends into the inner and outer surfaces 158*e* and 158*f* of the second plate member 138*b* toward the other of the inner and outer surfaces 158*e* and 158*f* of the second plate member 138*b* along the lateral direction A. The third plate member 138*c* can define a third recess 158 that extends into the inner and outer surfaces 158*e* and 158*f* of the third plate member 138*c* toward the other of the inner and outer surfaces 158*e* and 158*f* of the third plate member 138*c* along the lateral direction A. The fourth plate member 138*d* can define a fourth recess 158 that extends into the inner and outer surfaces 158*e* and 158*f* of the fourth plate member 138*d* toward the other of the inner and outer surfaces 158*e* and 158*f* of the fourth plate member 138*d* along the lateral direction A. The fifth plate member 138*e* can define a fifth recess 158 that extends into the inner and outer surfaces 158*e* and 158*f* of the fifth plate member 138*e* toward the other of the inner and outer surfaces 158*e* and 158*f* of the fifth plate member 138*e* along the lateral direction A.

In an example embodiment, only one of the first and second plate members 138*a* and 138*b* includes the recess 158. Alternatively, both of the first and second plate members 138 can include respective recesses 158. The recesses 158 can be supported by the respective inner surfaces 156*e* of each of the first and second plate members 138*a* and 138*b*.

Each recess 158 can be bound by opposed front and back recess sides 160*a* and 160*b*, respectively, that can be spaced apart from each other along the longitudinal direction L. For instance, the front recess side 160*a* can be disposed proximate to the front end 156*a*, and the back recess side 160*b* can be disposed proximate to the rear surface 156*b*. The opposed recess sides 160*a* and 160*b*, and thus the recess 158, can extend from the top surface 156*c* to the bottom surface 156*d* along the transverse direction T to define a recess height, although it will understood that the recess height can vary as desired. For instance, the recess 158 can be elongate in the transverse direction T and can extend downward in the transverse direction T from the top surface 156*c* until the recess terminates, for instance at the bottom surface 156*d*. Alternatively, the recess 158 can be elongate in the transverse direction T and can extend upward in the transverse direction T from the bottom surface 156*d* until the recess terminates, for instance at the top surface 156*c*. Thus, the recess 158 can extend from the top surface 156*c* of at least one of first and second plate members 138*a* and 138*b* to the bottom surface 156*d* of the at least one of first and second plate members 138*a* and 138*b*. In accordance with the illustrated embodiment, both the opposed recess sides 160*a* and 160*b*, and thus the recess 158, are closer to the front end 156*a* of the plate member 138 than the rear surface 156*b* of the plate member 138 along the longitudinal direction L. As described above, the height of at least one of the plate members 138 can vary as desired along the longitudinal direction L. For instance, with particular reference to FIGS. 11C and 12C, the plate members 138 can define a height rearward of the recess 158 that is greater that the height of the plate member forward of the recess 158 along the longitudinal direction L. By way of further example, the recess height can be less than the plate member height rearward of the recess 158, and the recess height can be at least equal to, for instance greater than, the plate member height forward of the recess along the longitudinal direction L.

It can be said that the plate members 138 have a thickness along the lateral direction A that can be defined by the distance between the inner and outer surfaces 156*e* and 156*f*, respectively, along the lateral direction A. Because the recesses 158 lessen a portion of the thickness of the respective plate member 138, the recesses 158 can be referred to as thin regions of the plate members 138, and the recesses 158 can define respective flex joints of the electrical contact 116.

Referring to FIGS. 4 and 8-12C, one or more of the plate members 138, for instance at least one of the first and second plate members 138*a* and 138*b* of the electrical contact 116, can define at least one slot, such as a slot 162 that can extend from the respective inner surface 156*e* to the respective outer surface 156*f* along the lateral direction A. It should be appreciated that the shape of the slots and number of the slots may vary as desired. For instance, the first plate member 138*a* can define a first slot 162 that extends from the inner surface 156*e* of the first plate member 138*a* to the outer surface 158*f* of the first plate member 138*a* along the lateral direction A. The second plate member 138*b* can define a second slot 162 that extends from the inner surface 156*e* of the second plate member 138*b* to the outer surface 158*f* of the second plate member 138*b* along the lateral direction A. The third plate member 138*c* can define a third slot 162 that extends from the inner surface 156*e* of the third plate member 138*c* to the outer surface 158*f* of the third plate member 138*c* along the lateral direction A. The fourth plate member 138*d* can define a fourth slot 162 that extends from the inner surface 156*e* of the fourth plate member 138*d* to the outer surface 158*f* of the fourth plate member 138*d* along the lateral direction A. The fifth plate member 138*e* can define a fifth slot 162 that extends from the inner surface 156*e* of the fifth plate member 138*e* to the outer surface 158*f* of the fifth plate member 138*e* along the lateral direction A.

Thus, at least one, for instance all, of the plate members 138 of the electrical contact 116 can include respective slots 162. In accordance with the illustrated embodiment, each illustrated slot 162 is disposed proximate to the front end 156*a* of the plate members 138, such that the front end 156*a* defines a portion of the slot 162. The slot 162 can extend into the front end 156*a* of at least one plate member 138 at a location spaced from the intermediate portion 142 along the transverse direction T that is perpendicular to both the longitudinal and transverse directions L and T. Further, the slot 162 can be disposed closer to the bottom surface 156*d* of at least one of the plate members 138 than the top surface 156*c* of the at least one plate member 138 along the transverse direction T, though it will be appreciated that the placement of the slot 162 can vary as desired.

In accordance with the illustrated embodiment, the slot 162 can include a first portion 164 that is substantially rectangular and a second portion 166 that is substantially rectangular and that extends from the first portion 164. For instance, the first portion 164 of the slot 162 can be elongate along the longitudinal direction L, and the first portion 164 can be defined by top and bottom slot sides 164*a* and 164*b*, respectively that are spaced apart and opposed from each other along the transverse direction T. Further, the first portion 164 can be disposed at the front end 156*a* such that at least a portion of the front end 156*a* can be open to the slot 162. The first portion 164 can further include a first portion end 164*c* that is opposite the front end 156*a* along the longitudinal direction L. The first portion end 164*c* can be disposed proximate to, for instance at, the front recess side 160*a*.

The second portion 166 can be defined by second opposed slot sides 166*a* and 166*b* that are spaced apart from each other along a direction $D_1$ (see FIGS. 8, 11C, and 12C) that has a component in both the lateral and transverse directions A and T, respectively. The second portion 166 of the slot 162 can further be defined by a second portion end 166*c* that extends between the opposed slot sides 166*a* and 166*b* along the direction $D_1$. Thus, it can be said that the second portion 166 of the slot 162 is substantially rectangular and extends upward from the first portion end 164*c* of the slot 162 to the second portion end 166*c* of the second portion 166 along a direction $D_2$ (see FIGS. 8, 11C, and 12C) that has a component in both the longitudinal and transverse directions L and T, respectively. In accordance with the illustrated embodiment, the second portion end 166*c* of the second portion 166, and thus the second portion end 166*c* of the slot 162, can be disposed closer to the bottom surface 156*d* of the plate member 138 than the top surface 156*c* of the plate member 138 along the transverse direction T. Furthermore, in accordance with the illustrated embodiment, the second portion end 166*c* of the second portion 166, and thus the second portion end 166*c* of the slot 162, can be disposed closer to the front end 156*a* of the plate member 138 than the rear surface 156*b* of the plate member 138 along the longitudinal direction L. The second portion end 166*c* can be disposed proximate to, for instance at, the back recess side 160*b*.

Figure 8:
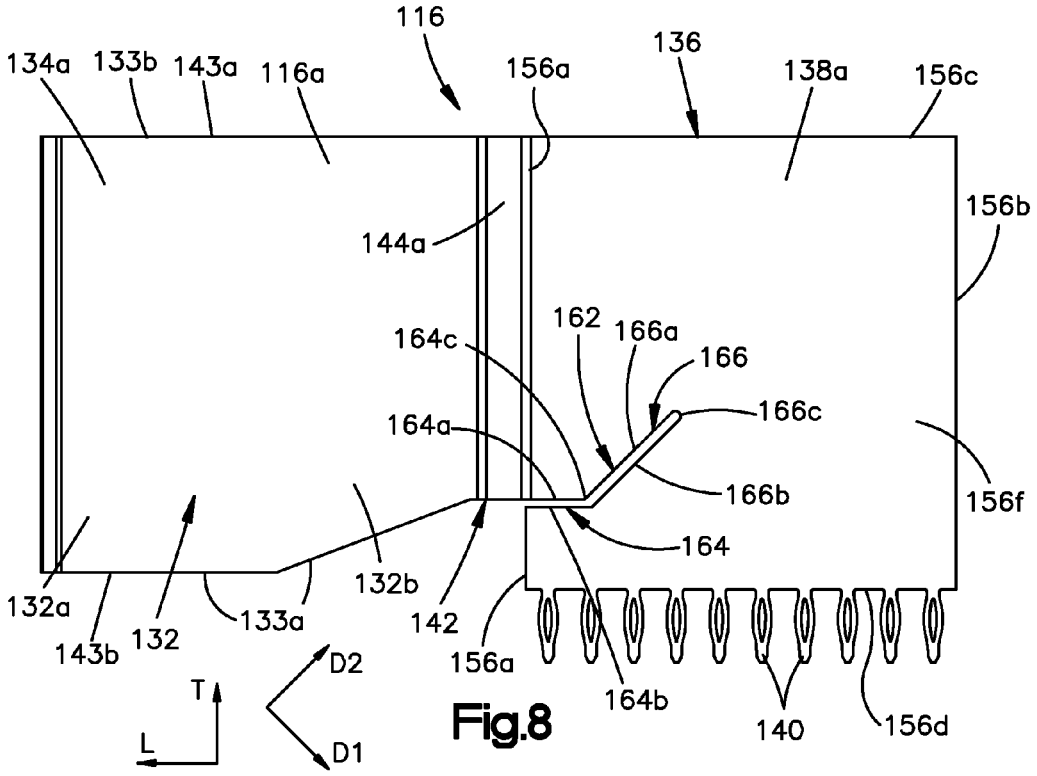
FIG. 8 is a side elevation view of the electrical contacts of the power connector illustrated in FIG. 3.
Figure 9:
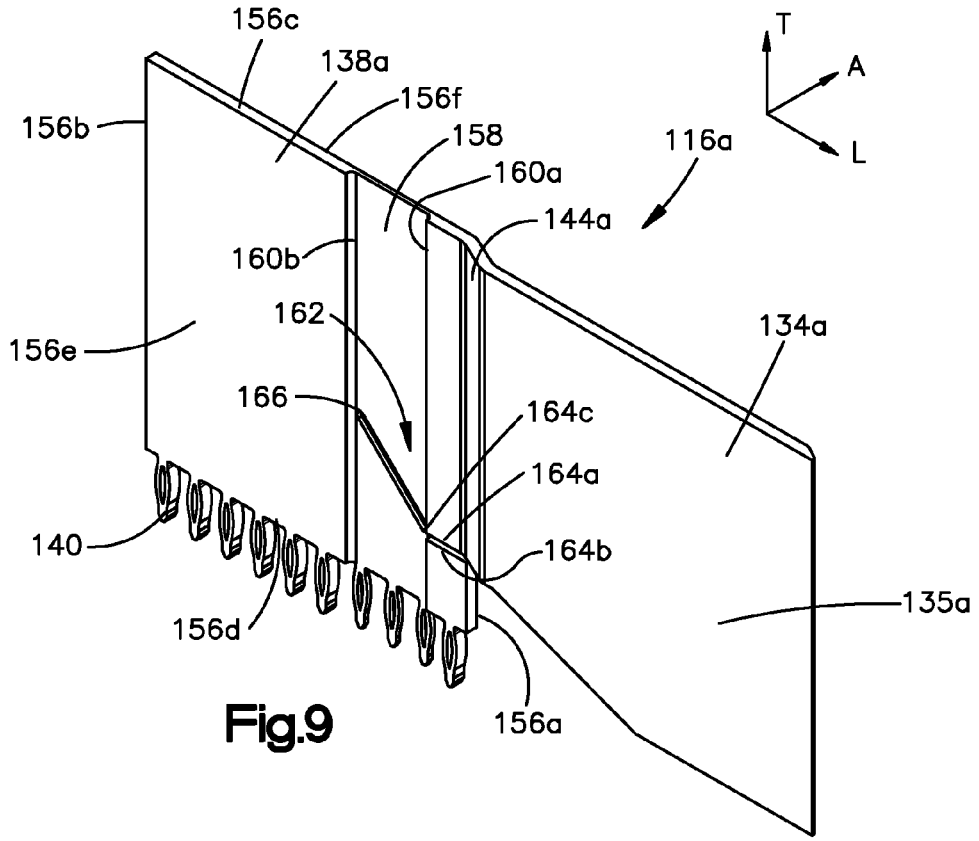
FIG. 9 is perspective view of a contact body of one of the electrical contacts illustrated in the power connector that is shown in FIG. 3.
Figure 10:
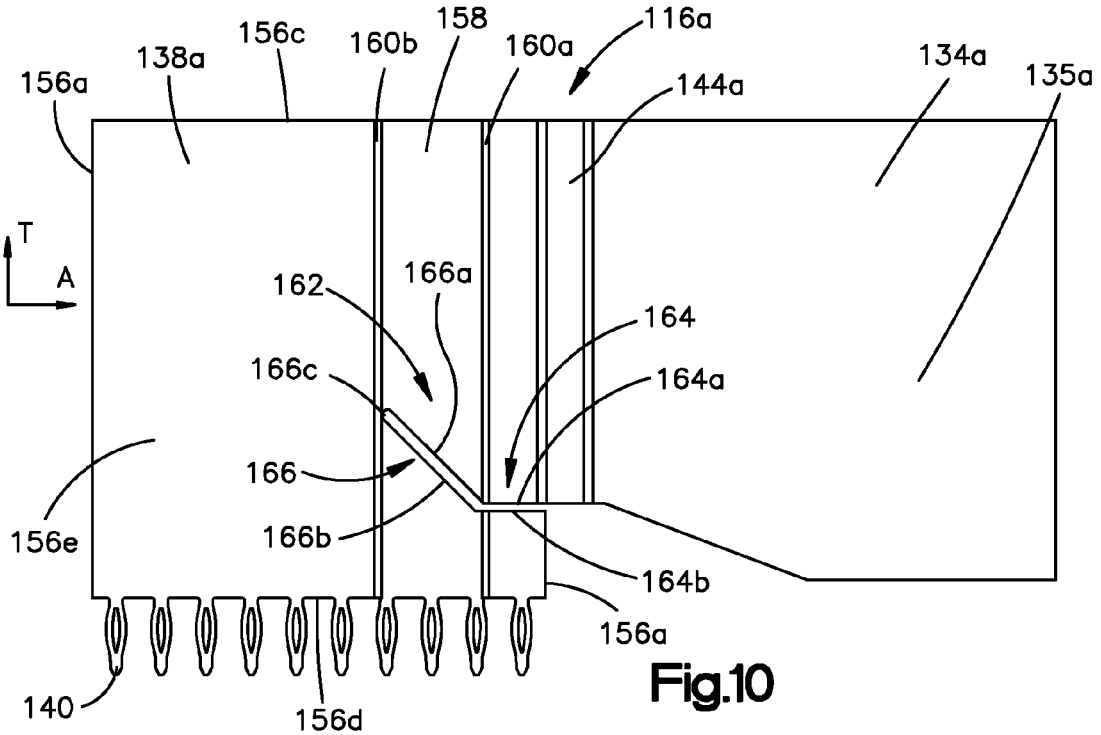
FIG. 10 is a side elevation view of the contact body that is shown in FIG. 9.

Referring particularly to FIGS. 8, 11C, and 12C, the mating portion 132 can include a bottom end 133*a* and a top end 133*b* that is spaced apart from the bottom end 133*a* along the transverse direction T. Thus, the mating end 132*a* of the mating portion 132 and the tapered end 132*b* of the mating portion 132 can include the bottom end 133*a* and the top end 133*b*. At the mating end 132*a*, the top end 133*b* can be substantially parallel to the bottom end 133*a* to define a mating end height. The mating end height can be substantially equal to the plate member height. Alternatively, at least a portion of the plate member height can be different than, for instance greater than, the mating end height. At the tapered end 132*b*, the bottom end 133*a* can be tapered toward the top end 133*b* along the rearward longitudinal direction, such that the height that is defined by the distance between the top end 133*b* and the bottom end 133*a* decreases rearwardly from the mating end height to a height that is defined by the intermediate portion 142. In accordance with the illustrated embodiment, the bottom end 133*a* of the intermediate portion 142 can terminate at the mouth of the slot 162. Thus, in accordance with the illustrated embodiment, the distance between the top surface 156*c* of the plate members 138 and the top slot side 164*a* of the slot 162 is substantially equal to the height of the intermediate portion 142 of the electrical contact 116. Further, the bottom end 133*a* can be configured so as to direct current around the slot in a clockwise direction, in accordance with the embodiment illustrated in FIG. 8. Although the illustrated bottom end 133*a* tapers linearly in the rearward longitudinal direction, it will be understood that the shape and size of the mating portion 132 can vary as desired.

As described above, at least a select one of plate members 138, for instance at least a select one of the first and second plate members 138*a* and 138*b* of the electrical contact 116, and thus at least a select one of the electrical contacts 116 of the power connector 106, can include at least one recess 158 or at least one slot 162. For instance, in accordance with the illustrated embodiment, at least a select one of the plate members 138 can include one recess 158 and one slot 162. Further, in accordance with the illustrated embodiments, each plate member 138 of the power connector 106, and thus each plate member 138 of each electrical contact 116 of the power connector 106, can include the recess 158 and the slot 162.

The recesses 158 and the slots 162 can be operatively configured to enhance the flexibility of respective electrical contacts 116, and thus the power connector 106. In addition, the recesses and the slots can be operatively configured to control current flow through the electrical contact 116 when the power connector 106 is mated with the complementary power connector 110. For instance, the slot 162 can be sized and/or shaped such that the electrical current that is transmitted to one of the mounting tails 140 is substantially equivalent to the current that is transmitted to each of the other mounting tails 140. For instance, the second portion 166 of the illustrated slot 162 can be elongate in the direction $D_2$ to cause current to flow toward the top surface 156*c* such that the current is equally distributed among the mounting tails 140. In addition, the tapered end 132*b* can terminate at the mouth of the slot 162 so that the current cannot flow below the slot 162, thus causing the electrical current to flow toward the rearwardly disposed mounting tails instead of directly to the forwardly disposed mounting tails 140.

Figure 13:
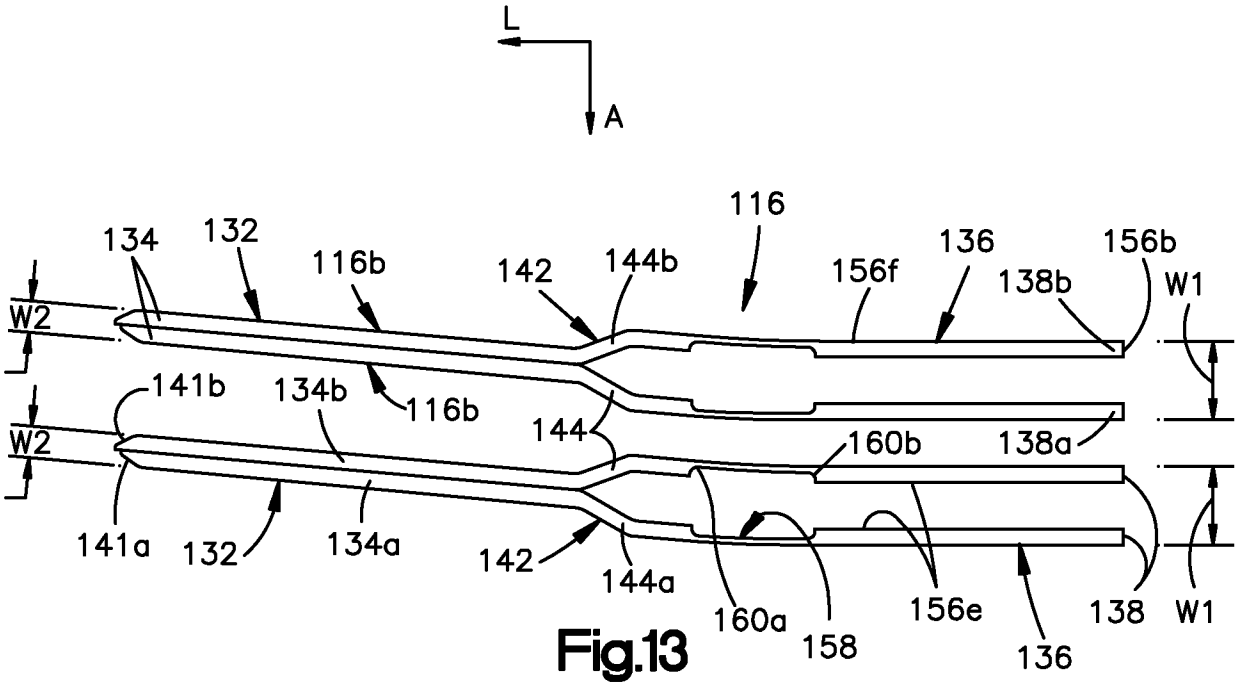
FIG. 13 is a top plan view of the electrical contacts of the power connector illustrated in FIG. 3, showing the electrical contacts in a flexed position such that the electrical contacts are angulated about a recess.

Referring to FIG. 13, at select portion of the electrical contact is configured to angulate with respect to at least a portion of the mounting portion 136. The select portion can include the mating portion 132. For instance, the angulation can be an elastic angulation within a range that causes the first and second forwardmost tips to deflecta distance between approximately 0.25 mm and approximately 3 mm along the lateral direction, such that at least one of the first and second contact blades 134*a* 134*b* slides along the other of the first and second contact blades 134*a* and 134*b*. The distance can, for instance, be between 0.1 mm and 3 mm. For instance, each of the first and second contact blades 134*a* and 134*b*, and in one example at the outer broad surface, is configured to receive an applied force in the lateral direction A that drives the angulation of the select portion relative to the mounting portion 136. Because the first and second contact blades 134*a* and 134*b* are configured to slide along each other, the shear force at the interface between the first and second contact blades 134*a* and 134*b* is reduced when a force is applied to the mating portion 132 in the lateral direction A that causes the angulation, with respect to an electrical contact whose contact blades 134*a* and 134*b* are fixed to each other. When the force applied is to the outer broad surface of one of the first and second contact blades sufficient to move the one of the first and second contact blades 134*a* and 134*b* along the lateral direction A toward the other of the first and second contact blades 134*a* and 134*b*, the force is transferred through the one of the first and second contact blades 134*a* and 134*b* to the other of the first and second contact blades 134*a* and 134*b* such that the other of the first and second contact blades 134*a* and 134*b* moves with the one of the first and second contact blades 134*a* and 134*b* along the lateral direction A.

The electrical contacts 116 can be configured such that a majority of the angulation of the select portion with respect to the at least a portion of the mounting portion 136 occurs at a predetermined region of the electrical power contact. For instance, the predetermined region can be disposed at the intermediate portion 142. In one example, between 75% and 100% of the elastic angulation of the select portion with respect to the at least a portion of the mounting portion occurs at the predetermined region. In accordance with one embodiment, the predetermined region does not change no matter where along the mating portion 132 along the longitudinal direction L the force is applied that causes the angulation. On accordance with one embodiment, at least one of the recesses 158, including both of the recesses 158, can define the predetermined region. Angulation of the select portion can cause the first and second contact blades 134*a* and 134*b* to move with respect to one another. Thus, it can be said that the mating portion 132 of the electrical contact 116 can be configured to angulate about the recess 158 with respect to the mounting portion 136 of the electrical contact 116. The mating portion 136 can be configured to angulate in a direction that lies in a plane that is defined by the longitudinal and lateral directions L and A, respectively.

With continuing reference to FIG. 13, one or more of the recess 158 of the electrical contact 116 can define a flex joint such that the mating portion 132 of the electrical contact 116 can angulate with respect to the mounting portion 136 of the electrical contact 116. In particular, the recess 158 can define the flex joint such that the mating portion 132 of the electrical contact 116 is configured to angulate about the recess 158 with respect to the mounting portion 136 of the electrical contact 116. For instance, in accordance with the illustrated embodiment shown in FIG. 13, the recesses 158 and/or the slots 162 can be operatively configured so as to enable the electrical contact 116 to be bent into a flexed position. In the flexed position, the mating portion 132 can angulate along the lateral direction a distance of at least, for instance greater than, 1 millimeter as compared to the unflexed position of the electrical contact 116.

Referring to FIGS. 3-8 and 13, the applied force that causes the select portion to angulate can further cause the first and second contact blades 134*a* and 134*b* to slide along each other with respect to the longitudinal direction L. For instance, when the applied force is applied direction to one of the first and second contact blades 134*a* and 134*b* in a sufficient amount that causes the respective forwardmost tips 141*a* and 141*b* to deflect along the lateral direction A, the one of the forwardmost tip of the other of the first and second contact blades 134*a* and 134*b* becomes displaced from the forwardmost tip of the one of the first and second contact blades 134*a* and 134*b* in the forward direction. For instance, the first inner broad surface 135*a* and the second inner broad surface 135*b* can be configured to slide along each other in the longitudinal direction L as the select portion angulates with respect to the mounting portion 136. In one example, the select portion can angulate with respect to the mounting portion 136 along the direction that lies in the plane defined by the longitudinal and lateral directions L and A, respectively. Thus, the first and second contact blades 134*a* and 134*b* are configured to angulate with respect to the mounting portion 136 along the direction that lies in the plane defined by the longitudinal and lateral directions L and A, respectively. Referring to FIGS. 11A-C, in accordance with the illustrated embodiment, the first inner broad surface 135*a* and one of the opposed broad surfaces 135*c* of the third contact blade 134*c* can be configured to slide along each other as the first and third contact blades 134*a* and 134*c* angulate along the direction that lies in the plane defined by the longitudinal and lateral directions L and A, and the second inner broad surface 135*b* and the other of the opposed broad surfaces 135*c* of the third contact blade 134*c* can be configured to slide along each other as the second and third contact blades 134*b* and 134*c* angulate along the direction that lies in the plane defined by the longitudinal and lateral directions L and A. Referring to FIGS. 12A-C, in accordance with the illustrated embodiment, the fourth inner broad surface 135*d* and the fifth inner broad surface 135*e* can be configured to slide along each other as the fourth and fifth contact blades 134*d* and 134*e* angulate along the direction that lies in the plane defined by the longitudinal and lateral directions L and A, respectively. Further, the outer broad surface 137 of the fourth contact blade 134*d* and the first inner broad surface 135*a* of the first contact blade 134*a* can be configured to slide along each other as the fourth and first contact blades 134*d* and 134*a* angulate along the direction that lies in the plane defined by the longitudinal and lateral directions L and A, respectively, and the outer broad surface 139 of the fifth contact blade 134*e* and the first inner broad surface 135*a* of the first contact blade 134*a* can be configured to slide along each other as the fifth and first contact blades 134*e* and 134*a* angulate along the direction that lies in the plane defined by the longitudinal and lateral directions L and A, respectively. The above-described angulations of the contact blades 135 can be caused by the broad surfaces of the contact blades sliding along each other.

Thus, the power connector 106 can be flexed so as to comply with various tolerances, for instance tolerances of the substrate 108 or tolerances of a complementary electrical component to which the power connector is to be mated, such as the complementary power connector 110. The slots 162 and/or the recesses 158 can be operatively configured to provide flexibility such that the contact blades 134 can angulate to engage with the corresponding mating portions 146 of the complementary electrical contact 120 while the mounting tails 140 are mounted to the substrate 108 so as to establish an electrical connection between the first and complementary substrates 108 and 112, respectively.

In operation, a method of mating an electrical power contact such as the electrical contact 116 to a complementary power contact such as the electrical contact 120 can include generally aligning the mating portion 132 of the electrical contact 116 with the mating portion 146 of the complementary electrical contact 120, wherein the mating portion 132 of the electrical contact 116 includes the first and second contact blades 134*a* and 134*b* that are disposed adjacent to each other. For instance, the first and second contact blades 134*a* and 134*b* can abut each other. The method can further include bringing the mating portion 132 of the electrical contact 116 into contact with the mating portion 146 of the complementary electrical contact 120 along the mating direction, such that the mating portion 312 receives a force from the connector housing 118 along the lateral direction. In response to the force, at least a portion of each of the first and second contact blades 134*a* and 134*b* is caused to deflect along the lateral direction L so as to align the first and second contact blades 134*a* and 134*b* with the complementary power contact 120. Subsequently, the method can include the step of mating the mating portion 132 with the mating portion of the complementary power contact 120. 35. The first and second contact blades 134*a* and 134*b* can remain deflected after the mating step. In response to the force, the at least one of the contact blades 134 can be caused to slide along the other of the contact blades 134 along the mating direction. Causing the first and second contact blades 134*a* and 134*b* to deflect can cause the mating portion 132 to angulate respect to the mounting portion 136 at the predetermined region. The method can further include mounting the electrical contact onto the underlying substrate 140 such that the mounting tails 140 of the mounting portion 136 are placed in electrical communication with the underlying substrate 140 so as to establish an electrical connection between the underlying substrate 140 and the complementary power contact 120.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, the invention is intended to encompass all modifications and alternative arrangements included within the spirit and scope of the invention, for instance as set forth by the appended claims.

For instance, it should be appreciated that a means for increasing the flexibility of a power contact may include a means for reducing at least a portion of the thickness of one or more plate members. Similarly, it should be appreciated that a means for increasing the flexibility of a power contact may include a means for removing a portion of one or more plate members so as to define at least one slot. Thus, a means for mating an electrical power connector to a complementary power connector may include generally aligning a mating portion of the electrical power contact with a mating portion of the complementary power contact, wherein the mating portion of the electrical power contact including first and second contact blades that are disposed adjacent to each other and can abut each other; bringing the mating portion of the electrical power contact into contact with the mating portion of the complementary power contact along a mating direction; and during the bringing step, causing one of the contact blades to slide along the other of the contact blades along the mating direction. The means for mating the electrical power connector can further include a means for angulating the mating portion with respect to a mounting portion during the bringing step; and mounting the mounting tails onto respective contact pads of an underlying substrate so as to establish an electrical connection between the underlying substrate and the complementary power contact. The means for mating the electrical connector may include a means for angulating the mating portion of the electrical power contact at least 1 millimeter, for instance greater than 1 millimeter, with respect to the mounting portion of the electrical power contact.

What is claimed:

1. An electrical power contact configured to mate with a complementary electrical power contact in a forward direction, the electrical power contact comprising:

a mounting portion configured to electrically connect to a substrate;

a mating portion that extends along a forward direction with respect to the mounting portion, the mating portion configured to mate with the complementary electrical power contact, the mating portion including first and second contact blades disposed adjacent each other and abutting each other along a second direction that is substantially perpendicular to the forward direction, wherein the first contact blade defines a first forwardmost tip, and the second contact blades defines a second forwardmost tip;

an intermediate portion that extends between the mating portion and the mounting portion, the intermediate portion configured to transmit electrical current between the mating portion and the mounting portion, wherein a select portion of the power contact is configured to elastically angulate with respect to at least a portion of the mounting portion within a range that causes the first and second forwardmost tips to deflect a distance between approximately 0.25 mm and approximately 3 mm in the second direction, such that at least one of the first and second contact blades slides along the other of the first and second contact blades.

2. The electrical power contact as recited in claim 1, wherein the distance is between approximately 1 mm and approximately 3 mm.

3. The electrical power contact as recited in claim 1, wherein the mounting portion defines a first width along the second direction, and the mating portion defines a second width along the second direction that is less than the first width.

4. The electrical power contact as recited in claim 3, wherein the first and second contact blades each have inner broad surfaces that face each other and respective outer broad surfaces that face away from each other, and the mating portion defines the second width from the outer broad surface of the first contact blade to the outer broad surface of the second contact blade along the second direction.

5. The electrical power contact as recited in claim 4, wherein a force applied to the outer broad surface of one of the first and second contact blades sufficient to move the one of the first and second contact blades along the second direction toward the other of the first and second contact blades is transferred through the one of the first and second contact blades to the other of the first and second contact blades, so as to cause the other of the first and second contact blades to move with the one of the first and second contact blades along the second direction.

6. The electrical power contact as recited in claim 3, wherein the mounting portion includes first and second plate members each having inner surfaces that face each other and respective outer surfaces that face away from each other, and the mounting portion defines the first width from the outer surface of the first plate member to the outer surface of the second plate member along the second direction.

7. The electrical power contact as recited in claim 6, wherein the first and second plate members remain stationary with respect to each other during angulation of the select portion of the electrical power contact.

8. The electrical power contact as recited in claim 6, wherein between 75% and 100% of the elastic angulation of the select portion with respect to the at least a portion of the mounting portion occurs at a predetermined region of the electrical power contact.

9. The electrical power contact as recited in claim 8, wherein at least one of first and second plate members defines a recess that extends into one of the respective inner and outer surfaces toward the other of the respective inner and outer surfaces along the second direction, and the recess defines the predetermined region.

10. The electrical power contact as recited in claim 9, wherein the recess terminates without extending through the other of the respective inner and outer surfaces along the second direction.

11. The electrical power contact as recited in claim 9, wherein the recess is a first recess that extends into the inner and outer surfaces of the first plate member toward the other of the inner and outer surfaces of the first plate member along the second direction, the electrical power contact further comprising:

a second recess that extends into the inner and outer surfaces of the second plate member toward the other of the inner and outer surfaces of the second plate member along the second direction.

12. The electrical power contact as recited in claim 9, wherein each of the plate members further defines a respective top surface and a respective bottom surface spaced from the respective top surface along a third direction that is substantially perpendicular to both the forward and second directions, and the recess extends from the top surface of the at least one of first and second plate members to the bottom surface of the at least one of first and second plate members.

13. The electrical power contact as recited in claim 6, wherein at least one of the first and second plate members defines a slot that extends from the respective inner surface to the respective outer surface along the second direction.

14. The electrical power contact as recited in claim 13, wherein the slot is a first slot that extends from the inner surface of the first plate member to the outer surface of the first plate member along the second direction, the electrical power contact further comprising:

a second slot that extends from the inner surface of the second plate member to the outer surface of the second plate member along the second direction.

15. The electrical power contact as recited in claim 13, wherein each of the first and second plate members define 1) a front end having at least a portion that extends from the intermediate portion in a rearward direction that extends along the forward direction, and 2) a rear surface that is spaced from the front end in the rearward direction, and 3) the slot extends into the front end of the at least one plate member at a location spaced from the intermediate portion along a third direction that is perpendicular to both the forward and second directions.

16. An electrical power connector comprising:

an electrically insulative connector housing defining a mating interface and a mounting interface; and at least one electrical power contact supported by the connector housing, the electrical power contact including 1) a mounting portion that extends out from the mounting interface and is configured to electrically connect to a substrate, 2) a mating portion that extends out from the mating interface and is configured to mate with a complementary electrical power contact along a forward direction, the mating portion including first and second contact blades disposed adjacent each other and abutting each other along a second direction that is substantially perpendicular to the forward direction, and 3) an intermediate portion that extends between the mating portion and the mounting portion, the intermediate portion configured to transmit electrical current between the mating portion and the mounting portion, wherein, in response to a force applied to one of the first and second contact blades along the second direction, a select portion of the power contact that includes the first and second contact blades angulates with respect to at least a portion of the mounting portion, and between 75% and 100% of the angulation occurs at a predetermined region of the electrical power contact.

17. The electrical power contact as recited in claim 16, wherein the predetermined region does not change no matter where at the one of the first and second contact blades mating portion along the forward direction the force is applied.

18. The electrical power contact as recited in claim 16, wherein the angulation is elastic and causes forwardmost tips of the first and second contact blades to deflect a distance between approximately 0.25 and approximately 3 mm in the second direction, such that at least one of the first and second contact blades slides along the other of the first and second contact blades.

19. The electrical power contact as recited in claim 18, wherein the distance is between approximately 1 mm and approximately 3 mm.

20. The electrical power connector as recited in claim 16, wherein the first contact blade includes a first inner broad surface and the second contact blade includes a second inner broad surface that faces the first inner broad surface, the first and second inner broad surfaces configured to slide along each other during the angulation.

21. A method of mating an electrical power contact of an electrical connector to a complementary power contact of a complementary electrical connector that includes an electrically insulative connector housing that supports the complementary power contact, the method comprising the steps of:

generally aligning a mating portion of the electrical power contact with a mating portion of the complementary power contact, the mating portion of the electrical power contact including first and second contact blades that are disposed adjacent to each other and abut each other;

bringing the mating portion of the electrical power contact into contact with the connector housing along a mating direction, such that the mating portion receives a force from the connector housing along a second direction that is substantially perpendicular with respect to the mating direction in response to the force, causing at least a portion of each of the first and second contact blades to deflect along the second direction so as to align the first and second contact blades with the complementary power contact; and after the causing step, mating the mating portion with the complementary power contact.

22. The method as recited in claim 21, wherein the electrical power contact further defines a mounting portion, wherein the causing step further comprises angulating the mating portion with respect to the mounting portion at a predetermined region of the electrical power contact.

23. The method as recited in claim 21, wherein the first and second contact blades remain deflected after the mating step.

24. The method as recited in claim 21, further comprising, in response to the force, causing one of the contact blades to slide along the other of the contact blades along the mating direction.

* * * * *